US008484019B2

(12) United States Patent
Hedelin et al.

(10) Patent No.: US 8,484,019 B2
(45) Date of Patent: Jul. 9, 2013

(54) AUDIO ENCODER AND DECODER

(75) Inventors: Per Hedelin, Göteborg (SE); Pontus Carlsson, Bromma (SE); Jonas Samuelsson, Sundbyberg (SE); Michael Schug, Erlangen (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 601 days.

(21) Appl. No.: 12/811,421

(22) PCT Filed: Dec. 30, 2008

(86) PCT No.: PCT/EP2008/011144

§ 371 (c)(1),
(2), (4) Date: Jul. 1, 2010

(87) PCT Pub. No.: WO2009/086918

PCT Pub. Date: Jul. 16, 2009

(65) Prior Publication Data

US 2010/0286991 A1 Nov. 11, 2010

Related U.S. Application Data

(60) Provisional application No. 61/055,978, filed on May 24, 2008.

(30) Foreign Application Priority Data

Jan. 4, 2008 (SE) ..... 0800032-5
May 24, 2008 (EP) ..... 08009530

(51) Int. Cl.
*G10L 19/00* (2006.01)

(52) U.S. Cl.
USPC ..... 704/219; 704/200; 704/200.1; 704/500; 704/501

(58) Field of Classification Search
USPC ..... 704/200–203, 219, 500–504
See application file for complete search history.

(56) References Cited

U.S. PATENT DOCUMENTS 5,553,191 A 9/1996 Minde
5,717,825 A 2/1998 Lamblin (Continued)

FOREIGN PATENT DOCUMENTS

EP 0673014 9/1995
EP 1262956 12/2002

(Continued)

OTHER PUBLICATIONS

Oger, M., et al., "Transform Audio Coding with Model-Based Bit Allocation" Proceedings of ICASSP 2007, vol. 4, Apr. 15-20, 2007, pp. 545-548.

(Continued)

*Primary Examiner* — Douglas Godbold

(57) ABSTRACT

The present invention teaches a new audio coding system that can code both general audio and speech signals well at low bit rates. A proposed audio coding system comprises linear prediction unit for filtering an input signal based on an adaptive filter; a transformation unit for transforming a frame of the filtered input signal into a transform domain; and a quantization unit for quantizing the transform domain signal. The quantization unit decides, based on input signal characteristics, to encode the transform domain signal with a model-based quantizer or a non-model-based quantizer. Preferably, the decision is based on the frame size applied by the transformation unit.

9 Claims, 21 Drawing Sheets

U.S. PATENT DOCUMENTS

| | | | | |
|---|---|---|---|---|
| 6,012,025 | A | 1/2000 | Yin | |
| 6,243,673 | B1 | 6/2001 | Ohno | |
| 6,389,006 | B1 | 5/2002 | Bialik | |
| 6,611,800 | B1 | 8/2003 | Nishiguchi | |
| 6,879,955 | B2 | 4/2005 | Rao | |
| 7,457,743 | B2 | 11/2008 | Ojanpera | |
| 7,460,993 | B2 | 12/2008 | Chen | |
| 7,610,195 | B2 | 10/2009 | Ojanpera | |
| 7,720,677 | B2 | 5/2010 | Villemoes | |
| 8,032,362 | B2 | 10/2011 | Choo | |
| 2002/0010577 | A1* | 1/2002 | Matsumoto et al. | 704/219 |
| 2002/0040299 | A1* | 4/2002 | Makino et al. | 704/500 |
| 2003/0215013 | A1 | 11/2003 | Budnikov | |
| 2005/0010404 | A1* | 1/2005 | Son et al. | 704/219 |
| 2007/0100607 | A1 | 5/2007 | Villemoes | |
| 2007/0106502 | A1 | 5/2007 | Kim | |
| 2007/0282599 | A1 | 12/2007 | Choo | |
| 2008/0270124 | A1 | 10/2008 | Son | |
| 2009/0228290 | A1* | 9/2009 | Chen et al. | 704/500 |
| 2010/0138218 | A1 | 6/2010 | Geiger | |

FOREIGN PATENT DOCUMENTS

| | | | |
|---|---|---|---|
| EP | 1278184 | A2 | 1/2003 |
| JP | 9-127998 | | 5/1997 |
| JP | 2001-142499 | | 5/2001 |
| JP | 2003-044097 | | 2/2003 |
| JP | 2004-246038 | | 9/2004 |
| JP | 2007-286200 | | 11/2007 |
| KR | 2002-0077959 | | 10/2002 |
| KR | 10-2006-0121973 | | 11/2006 |
| RU | 2144261 | | 1/2000 |
| RU | 98103512 | | 1/2000 |
| WO | 95/28699 | | 10/1995 |
| WO | 02/41302 | | 5/2002 |
| WO | 2006008817 | | 1/2006 |

OTHER PUBLICATIONS

Niamut, O., et al., "RD Optimal Time Segmentations for the Time-Varying MDCT" Proceedings of the European Signal Processing Conference, Sep. 6, 2004, pp. 1649-1652.

Ojanpera, J., et al., "Long Term Predictor for Transform Domain Perceptual Audio Coding", AES Convention 107, No. 5036, Sep. 24-27, 1999, pp. 1-10.

Chen, Juin-Hwey, "A Candidate Coder for the ITU-T's New Wideband Speech Coding Standard" ICASSP-97, vol. 2, pp. 1359-1362, Apr. 21-24, 1997.

Marie Oger et al, "Transform Audio Coding with Model-Based Bit Allocation", Proceedings of ICASSP 2007, vol. 4, Apr. 15-20, 2007, pp. 545-548.

* cited by examiner

AUDIO ENCODER AND DECODER

TECHNICAL FIELD

The present invention relates to coding of audio signals, and in particular to the coding of any audio signal not limited to either speech, music or a combination thereof.

BACKGROUND OF THE INVENTION

In prior art there are speech coders specifically designed to code speech signals by basing the coding upon a source model of the signal, i.e. the human vocal system. These coders cannot handle arbitrary audio signals, such as music, or any other non-speech signal. Additionally, there are in prior art music-coders, commonly referred to as audio coders that base their coding on assumptions on the human auditory system, and not on the source model of the signal. These coders can handle arbitrary signals very well, albeit at low bit rates for speech signals, the dedicated speech coder gives a superior audio quality. Hence, no general coding structure exists so far for coding of arbitrary audio signals that performs as well as a speech coder for speech and as well as a music coder for music, when operated at low bit rates.

Thus, there is a need for an enhanced audio encoder and decoder with improved audio quality and/or reduced bit rates.

SUMMARY OF THE INVENTION

The present invention relates to efficiently coding arbitrary audio signals at a quality level equal or better than that of a system specifically tailored to a specific signal.

The present invention is directed at audio codec algorithms that contain both a linear prediction coding (LPC) and a transform coder part operating on a LPC processed signal.

The present invention further relates to a quantization strategy depending on a transform frame size. Furthermore, a model-based entropy constraint quantizer employing arithmetic coding is proposed. In addition, the insertion of random offsets in a uniform scalar quantizer is provided. The invention further suggests a model-based quantizer, e.g, an Entropy Constraint Quantizer (ECQ), employing arithmetic coding.

The present invention further relates to efficiently coding of scalefactors in the transform coding part of an audio encoder by exploiting the presence of LPC data.

The present invention further relates to efficiently making use of a bit reservoir in an audio encoder with a variable frame size.

The present invention further relates to an encoder for encoding audio signals and generating a bitstream, and a decoder for decoding the bitstream and generating a reconstructed audio signal that is perceptually indistinguishable from the input audio signal.

A first aspect of the present invention relates to quantization in a transform encoder that, e.g., applies a Modified Discrete Cosine Transform (MDCT). The proposed quantizer preferably quantizes MDCT lines. This aspect is applicable independently of whether the encoder further uses a linear prediction coding (LPC) analysis or additional long term prediction (LTP).

The present invention provides an audio coding system comprising a linear prediction unit for filtering an input signal based on an adaptive filter; a transformation unit for transforming a frame of the filtered input signal into a transform domain; and a quantization unit for quantizing the transform domain signal. The quantization unit decides, based on input signal characteristics, to encode the transform domain signal with a model-based quantizer or a non-model-based quantizer. Preferably, the decision is based on the frame size applied by the transformation unit. However, other input signal dependent criteria for switching the quantization strategy are envisaged as well and are within the scope of the present application.

Another important aspect of the invention is that the quantizer may be adaptive. In particular the model in the model-based quantizer may be adaptive to adjust to the input audio signal. The model may vary over time, e.g., depending on input signal characteristics. This allows reduced quantization distortion and, thus, improved coding quality.

According to an embodiments, the proposed quantization strategy is conditioned on frame-size. It is suggested that the quantization unit may decide, based on the frame size applied by the transformation unit, to encode the transform domain signal with a model-based quantizer or a non-model-based quantizer. Preferably, the quantization unit is configured to encode a transform domain signal for a frame with a frame size smaller than a threshold value by means of a model-based entropy constrained quantization. The model-based quantization may be conditioned on assorted parameters. Large frames may be quantized, e.g., by a scalar quantizer with e.g. Huffman based entropy coding, as is used in e.g. the AAC codec.

The audio coding system may further comprise a long term prediction (LTP) unit for estimating the frame of the filtered input signal based on a reconstruction of a previous segment of the filtered input signal and a transform domain signal combination unit for combining, in the transform domain, the long term prediction estimation and the transformed input signal to generate the transform domain signal that is input to the quantization unit.

The switching between different quantization methods of the MDCT lines is another aspect of a preferred embodiment of the invention. By employing different quantization strategies for different transform sizes, the codec can do all the quantization and coding in the MDCT-domain without having the need to have a specific time domain speech coder running in parallel or serial to the transform domain codec. The present invention teaches that for speech like signals, where there is an LTP gain, the signal is preferably coded using a short transform and a model-based quantizer. The model-based quantizer is particularly suited for the short transform, and gives, as will be outlined later, the advantages of a time-domain speech specific vector quantizer (VQ), while still being operated in the MDCT-domain, and without any requirements that the input signal is a speech signal. In other words, when the model-based quantizer is used for the short transform segments in combination with the LTP, the efficiency of the dedicated time-domain speech coder VQ is retained without loss of generality and without leaving the MDCT-domain.

In addition for more stationary music signals, it is preferred to use a transform of relatively large size as is commonly used in audio codecs, and a quantization scheme that can take advantage of sparse spectral lines discriminated by the large transform. Therefore, the present invention teaches to use this kind of quantization scheme for long transforms.

Thus, the switching of quantization strategy as a function of frame size enables the codec to retain both the properties of a dedicated speech codec, and the properties of a dedicated audio codec, simply by choice of transform size. This avoids all the problems in prior art systems that strive to handle speech and audio signals equally well at low rates, since these systems inevitably run into the problems and difficulties of efficiently combining time-domain coding (the speech coder) with frequency domain coding (the audio coder).

According to another aspect of the invention, the quantization uses adaptive step sizes. Preferably, the quantization step size(s) for components of the transform domain signal is/are adapted based on linear prediction and/or long term prediction parameters. The quantization step size(s) may further be configured to be frequency depending. In embodiments of the invention, the quantization step size is determined based on at least one of: the polynomial of the adaptive filter, a coding rate control parameter, a long term prediction gain value, and an input signal variance.

Preferably, the quantization unit comprises uniform scalar quantizers for quantizing the transform domain signal components. Each scalar quantizer is applying a uniform quantization, e.g. based on a probability model, to a MDCT line. The probability model may be a Laplacian or a Gaussian model, or any other probability model that is suitable for signal characteristics. The quantization unit may further insert a random offset into the uniform scalar quantizers. The random offset insertion provides vector quantization advantages to the uniform scalar quantizers. According to an embodiment, the random offsets are determined based on an optimization of a quantization distortion, preferably in a perceptual domain and/or under consideration of the cost in terms of the number of bits required to encode the quantization indices.

The quantization unit may further comprise an arithmetic encoder for encoding quantization indices generated by the uniform scalar quantizers. This achieves a low bit rate approaching the possible minimum as given by the signal entropy.

The quantization unit may further comprise a residual quantizer for quantizing a residual quantization signal resulting from the uniform scalar quantizers in order to further reduce the overall distortion. The residual quantizer preferably is a fixed rate vector quantizer.

Multiple quantization reconstruction points may be used in the de-quantization unit of the encoder and/or the inverse quantizer in the decoder. For instance, minimum mean squared error (MMSE) and/or center point (midpoint) reconstruction points may be used to reconstruct a quantized value based on its quantization index. A quantization reconstruction point may further be based on a dynamic interpolation between a center point and a MMSE point, possibly controlled by characteristics of the data. This allows controlling noise insertion and avoiding spectral holes due to assigning MDCT lines to a zero quantization bin for low bit rates.

A perceptual weighting in the transform domain is preferably applied when determining the quantization distortion in order to put different weights to specific frequency components. The perceptual weights may be efficiently derived from linear prediction parameters.

Another independent aspect of the invention relates to the general concept of making use of the coexistence of LPC and SCF (ScaleFactor) data. In a transform based encoder, e.g. applying a Modified Discrete Cosine Transform (MDCT), scalefactors may be used in quantization to control the quantization step size. In prior art, these scalefactors are estimated from the original signal to determine a masking curve. It is now suggested to estimate a second set of scalefactors with the help of a perceptual filter or psychoacoustic model that is calculated from LPC data. This allows a reduction of the cost for transmitting/storing the scalefactors by transmitting/storing only the difference of the actually applied scalefactors to the LPC-estimated scalefactors instead of transmitting/storing the real scalefactors. Thus, in an audio coding system containing speech coding elements, such as e.g. an LPC, and transform coding elements, such as a MDCT, the present invention reduces the cost for transmitting scalefactor information needed for the transform coding part of the codec by exploiting data provided by the LPC. It is to be noted that this aspect is independent of other aspects of the proposed audio coding system and can be implemented in other audio coding systems as well.

For instance, a perceptual masking curve may be estimated based on the parameters of the adaptive filter. The linear prediction based second set of scalefactors may be determined based on the estimated perceptual masking curve. Stored/transmitted scalefactor information is then determined based on the difference between the scalefactors actually used in quantization and the scalefactors that are calculated from the LPC-based perceptual masking curve. This removes dynamics and redundancy from the stored/transmitted information so that fewer bits are necessary for storing/transmitting the scalefactors.

In case that the LPC and the MDCT do not operate on the same frame rate, i.e. having different frame sizes, the linear prediction based scalefactors for a frame of the transform domain signal may be estimated based on interpolated linear prediction parameters so as to correspond to the time window covered by the MDCT frame.

The present invention therefore provides an audio coding system that is based on a transform coder and includes fundamental prediction and shaping modules from a speech coder. The inventive system comprises a linear prediction unit for filtering an input signal based on an adaptive filter; a transformation unit for transforming a frame of the filtered input signal into a transform domain; a quantization unit for quantizing a transform domain signal; a scalefactor determination unit for generating scalefactors, based on a masking threshold curve, for usage in the quantization unit when quantizing the transform domain signal; a linear prediction scalefactor estimation unit for estimating linear prediction based scalefactors based on parameters of the adaptive filter; and a scalefactor encoder for encoding the difference between the masking threshold curve based scalefactors and the linear prediction based scalefactors. By encoding the difference between the applied scalefactors and scalefactors that can be determined in the decoder based on available linear prediction information, coding and storage efficiency can be improved and only fewer bits need to be stored/transmitted.

Another independent encoder specific aspect of the invention relates to bit reservoir handling for variable frame sizes. In an audio coding system that can code frames of variable length, the bit reservoir is controlled by distributing the available bits among the frames. Given a reasonable difficulty measure for the individual frames and a bit reservoir of a defined size, a certain deviation from a required constant bit rate allows for a better overall quality without a violation of the buffer requirements that are imposed by the bit reservoir size. The present invention extends the concept of using a bit reservoir to a bit reservoir control for a generalized audio codec with variable frame sizes. An audio coding system may therefore comprise a bit reservoir control unit for determining the number of bits granted to encode a frame of the filtered signal based on the length of the frame and a difficulty measure of the frame. Preferably, the bit reservoir control unit has separate control equations for different frame difficulty measures and/or different frame sizes. Difficulty measures for different frame sizes may be normalized so they can be compared more easily. In order to control the bit allocation for a variable rate encoder, the bit reservoir control unit preferably sets the lower allowed limit of the granted bit control algorithm to the average number of bits for the largest allowed frame size.

A further aspect of the invention relates to the handling of a bitreservoir in an encoder employing a model-based quantizer, e.g, an Entropy Constraint Quantizer (ECQ). It is suggested to minimize the variation of ECQ step size. A particular control equation is suggested that relates the quantizer step size to the ECQ rate.

The adaptive filter for filtering the input signal is preferably based on a Linear Prediction Coding (LPC) analysis including a LPC filter producing a whitened input signal. LPC parameters for the present frame of input data may be determined by algorithms known in the art. A LPC parameter estimation unit may calculate, for the frame of input data, any suitable LPC parameter representation such as polynomials, transfer functions, reflection coefficients, line spectral frequencies, etc. The particular type of LPC parameter representation that is used for coding or other processing depends on the respective requirements. As is known to the skilled person, some representations are more suited for certain operations than others and are therefore preferred for carrying out these operations. The linear prediction unit may operate on a first frame length that is fixed, e.g. 20 msec. The linear prediction filtering may further operate on a warped frequency axis to selectively emphasize certain frequency ranges, such as low frequencies, over other frequencies.

The transformation applied to the frame of the filtered input signal is preferably a Modified Discrete Cosine Transform (MDCT) operating on a variable second frame length. The audio coding system may comprise a window sequence control unit determining, for a block of the input signal, the frame lengths for overlapping MDCT windows by minimizing a coding cost function, preferably a simplistic perceptual entropy, for the entire input signal block including several frames. Thus, an optimal segmentation of the input signal block into MDCT windows having respective second frame lengths is derived. In consequence, a transform domain coding structure is proposed, including speech coder elements, with an adaptive length MDCT frame as only basic unit for all processing except the LPC. As the MDCT frame lengths can take on many different values, an optimal sequence can be found and abrupt frame size changes can be avoided, as are common in prior art where only a small window size and a large window size is applied. In addition, transitional transform windows having sharp edges, as used in some prior art approaches for the transition between small and large window sizes, are not necessary.

Preferably, consecutive MDCT window lengths change at most by a factor of two (2) and/or the MDCT window lengths are dyadic values. More particular, the MDCT window lengths may be dyadic partitions of the input signal block. The MDCT window sequence is therefore limited to predetermined sequences which are easy to encode with a small number of bits. In addition, the window sequence has smooth transitions of frame sizes, thereby excluding abrupt frame size changes.

The window sequence control unit may be further configured to consider long term prediction estimations, generated by the long term prediction unit, for window length candidates when searching for the sequence of MDCT window lengths that minimizes the coding cost function for the input signal block. In this embodiment, the long term prediction loop is closed when determining the MDCT window lengths which results in an improved sequence of MDCT windows applied for encoding.

The audio coding system may further comprise a LPC encoder for recursively coding, at a variable rate, line spectral frequencies or other appropriate LPC parameter representations generated by the linear prediction unit for storage and/or transmission to a decoder. According to an embodiment, a linear prediction interpolation unit is provided to interpolate linear prediction parameters generated on a rate corresponding to the first frame length so as to match the variable frame lengths of the transform domain signal.

According to an aspect of the invention, the audio coding system may comprise a perceptual modeling unit that modifies a characteristic of the adaptive filter by chirping and/or tilting a LPC polynomial generated by the linear prediction unit for a LPC frame. The perceptual model received by the modification of the adaptive filter characteristics may be used for many purposes in the system. For instance, it may be applied as perceptual weighting function in quantization or long term prediction.

Another aspect of the invention relates to long term prediction (LTP), in particular to long term prediction in the MDCT-domain, MDCT frame adapted LTP and MDCT weighted LTP search. These aspects are applicable irrespective whether a LPC analysis is present upstream of the transform coder.

According to an embodiment, the audio coding system further comprises an inverse quantization and inverse transformation unit for generating a time domain reconstruction of the frame of the filtered input signal. Furthermore, a long term prediction buffer for storing time domain reconstructions of previous frames of the filtered input signal may be provided. These units may be arranged in a feedback loop from the quantization unit to a long term prediction extraction unit that searches, in the long term prediction buffer, for the reconstructed segment that best matches the present frame of the filtered input signal. In addition, a long term prediction gain estimation unit may be provided that adjusts the gain of the selected segment from the long term prediction buffer so that it best matches the present frame. Preferably, the long term prediction estimation is subtracted from the transformed input signal in the transform domain. Therefore, a second transform unit for transforming the selected segment into the transform domain may be provided. The long term prediction loop may further include adding the long term prediction estimation in the transform domain to the feedback signal after inverse quantization and before inverse transformation into the time-domain. Thus, a backward adaptive long term prediction scheme may be used that predicts, in the transform domain, the present frame of the filtered input signal based on previous frames. In order to be more efficient, the long term prediction scheme may be further adapted in different ways, as set out below for some examples.

According to an embodiment, the long term prediction unit comprises a long term prediction extractor for determining a lag value specifying the reconstructed segment of the filtered signal that best fits the current frame of the filtered signal. A long term prediction gain estimator may estimate a gain value applied to the signal of the selected segment of the filtered signal. Preferably, the lag value and the gain value are determined so as to minimize a distortion criterion relating to the difference, in a perceptual domain, of the long term prediction estimation to the transformed input signal. A modified linear prediction polynomial may be applied as MDCT-domain equalization gain curve when minimizing the distortion criterion.

The long term prediction unit may comprise a transformation unit for transforming the reconstructed signal of segments from the LTP buffer into the transform domain. For an efficient implementation of a MDCT transformation, the transformation is preferably a type-W Discrete-Cosine Transformation.

Another aspect of the invention relates to an audio decoder for decoding the bitstream generated by embodiments of the above encoder. A decoder according to an embodiment comprises a de-quantization unit for de-quantizing a frame of an input bitstream based on scalefactors; an inverse transformation unit for inversely transforming a transform domain signal; a linear prediction unit for filtering the inversely transformed transform domain signal; and a scalefactor decoding unit for generating the scalefactors used in de-quantization based on received scalefactor delta information that encodes the difference between the scalefactors applied in the encoder and scalefactors that are generated based on parameters of the adaptive filter. The decoder may further comprise a scalefactor determination unit for generating scalefactors based on a masking threshold curve that is derived from linear prediction parameters for the present frame. The scalefactor decoding unit may combine the received scalefactor delta information and the generated linear prediction based scalefactors to generate scalefactors for input to the de-quantization unit.

A decoder according to another embodiment comprises a model-based de-quantization unit for de-quantizing a frame of an input bitstream; an inverse transformation unit for inversely transforming a transform domain signal; and a linear prediction unit for filtering the inversely transformed transform domain signal. The de-quantization unit may comprise a non-model based and a model based de-quantizer.

Preferably, the de-quantization unit comprises at least one adaptive probability model. The de-quantization unit may be configured to adapt the de-quantization as a function of the transmitted signal characteristics.

The de-quantization unit may further decide a de-quantization strategy based on control data for the decoded frame. Preferably, the de-quantization control data is received with the bitstream or derived from received data. For example, the de-quantization unit decides the de-quantization strategy based on the transform size of the frame.

According to another aspect, the de-quantization unit comprises adaptive reconstruction points. The de-quantization unit may comprise uniform scalar de-quantizers that are configured to use two de-quantization reconstruction points per quantization interval, in particular a midpoint and a MMSE reconstruction point.

According to an embodiment, the de-quantization unit uses a model based quantizer in combination with arithmetic coding.

In addition, the decoder may comprise many of the aspects as disclosed above for the encoder. In general, the decoder will mirror the operations of the encoder, although some operations are only performed in the encoder and will have no corresponding components in the decoder. Thus, what is disclosed for the encoder is considered to be applicable for the decoder as well, if not stated otherwise.

The above aspects of the invention may be implemented as a device, apparatus, method, or computer program operating on a programmable device. Inventive aspects may further be embodied in signals, data structures and bitstreams.

Thus, the application further discloses an audio encoding method and an audio decoding method. An exemplary audio encoding method comprises the steps of: filtering an input signal based on an adaptive filter; transforming a frame of the filtered input signal into a transform domain; quantizing the transform domain signal; generating scalefactors, based on a masking threshold curve, for usage in the quantization unit when quantizing the transform domain signal; estimating linear prediction based scalefactors based on parameters of the adaptive filter; and encoding the difference between the masking threshold curve based scalefactors and the linear prediction based scalefactors.

Another audio encoding method comprises the steps: filtering an input signal based on an adaptive filter; transforming a frame of the filtered input signal into a transform domain; and quantizing the transform domain signal; wherein the quantization unit decides, based on input signal characteristics, to encode the transform domain signal with a model-based quantizer or a non-model-based quantizer.

An exemplary audio decoding method comprises the steps of: de-quantizing a frame of an input bitstream based on scalefactors; inversely transforming a transform domain signal; linear prediction filtering the inversely transformed transform domain signal; estimating second scalefactors based on parameters of the adaptive filter; and generating the scalefactors used in de-quantization based on received scalefactor difference information and the estimated second scalefactors.

Another audio encoding method comprises the steps: de-quantizing a frame of an input bitstream; inversely transforming a transform domain signal; and linear prediction filtering the inversely transformed transform domain signal; wherein the de-quantization is using a non-model and a model-based quantizer.

These are only examples of preferred audio encoding/decoding methods and computer programs that are taught by the present application and that a person skilled in the art can derive from the following description of exemplary embodiments.

BRIEF DESCRIPTION OF THE DRAWINGS

The present invention will now be described by way of illustrative examples, not limiting the scope or spirit of the invention, with reference to the accompanying drawings, in which.

DESCRIPTION OF PREFERRED EMBODIMENTS

The below-described embodiments are merely illustrative for the principles of the present invention for audio encoder and decoder. It is understood that modifications and variations of the arrangements and the details described herein will be apparent to others skilled in the art. It is the intent, therefore, to be limited only by the scope of the accompanying patent claims and not by the specific details presented by way of description and explanation of the embodiments herein. Similar components of embodiments are numbered by similar reference numbers.

Figure 1:
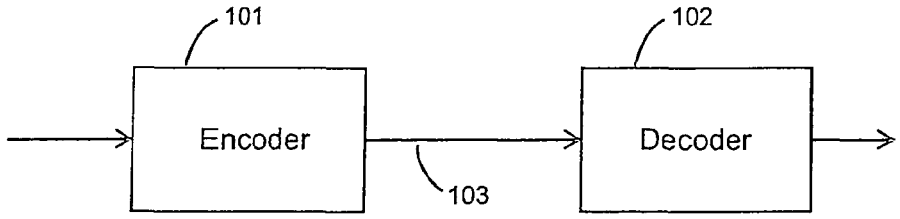
FIG. 1 illustrates a preferred embodiment of an encoder and a decoder according to the present invention.

In FIG. 1 an encoder 101 and a decoder 102 are visualized. The encoder 101 takes the time-domain input signal and produces a bitstream 103 subsequently sent to the decoder 102. The decoder 102 produces an output wave-form based on the received bitstream 103. The output signal psychoacoustically resembles the original input signal.

Figure 2:
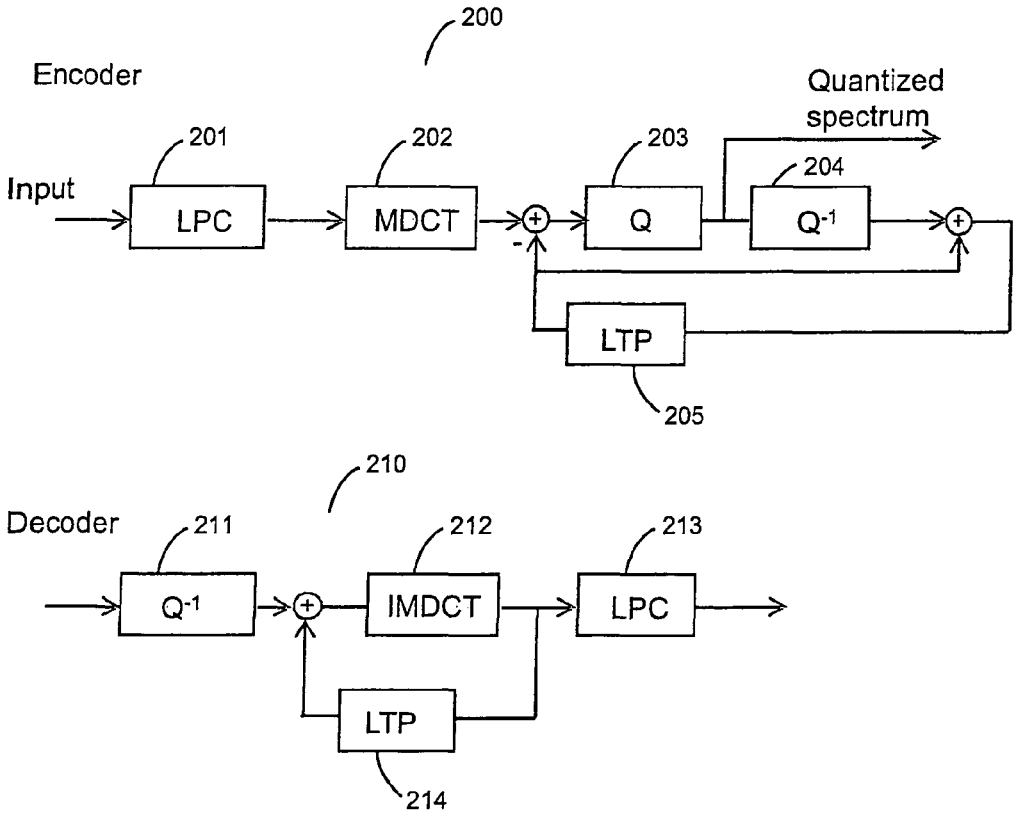
FIG. 2 illustrates a more detailed view of the encoder and the decoder according to the present invention.

In FIG. 2 a preferred embodiment of the encoder 200 and the decoders 210 are illustrated. The input signal in the encoder 200 is passed through a LPC (Linear Prediction Coding) module 201 that generates a whitened residual signal for an LPC frame having a first frame length, and the corresponding linear prediction parameters. Additionally, gain normalization may be included in the LPC module 201. The residual signal from the LPC is transformed into the frequency domain by an MDCT (Modified Discrete Cosine Transform) module 202 operating on a second variable frame length. In the encoder 200 depicted in FIG. 2, an LTP (Long Term Prediction) module 205 is included. LTP will be elaborated on in a further embodiment of the present invention. The MDCT lines are quantized 203 and also de-quantized 204 in order to feed a LTP buffer with a copy of the decoded output as will be available to the decoder 210. Due to the quantization distortion, this copy is called reconstruction of the respective input signal. In the lower part of FIG. 2 the decoder 210 is depicted. The decoder 210 takes the quantized MDCT lines, de-quantizes 211 them, adds the contribution from the LTP module 214, and does an inverse MDCT transform 212, followed by an LPC synthesis filter 213.

An important aspect of the above embodiment is that the MDCT frame is the only basic unit for coding, although the LPC has its own (and in one embodiment constant) frame size and LPC parameters are coded, too. The embodiment starts from a transform coder and introduces fundamental prediction and shaping modules from a speech coder. As will be discussed later, the MDCT frame size is variable and is adapted to a block of the input signal by determining the optimal MDCT window sequence for the entire block by minimizing a simplistic perceptual entropy cost function. This allows scaling to maintain optimal time/frequency control. Further, the proposed unified structure avoids switched or layered combinations of different coding paradigms.

Figure 3:
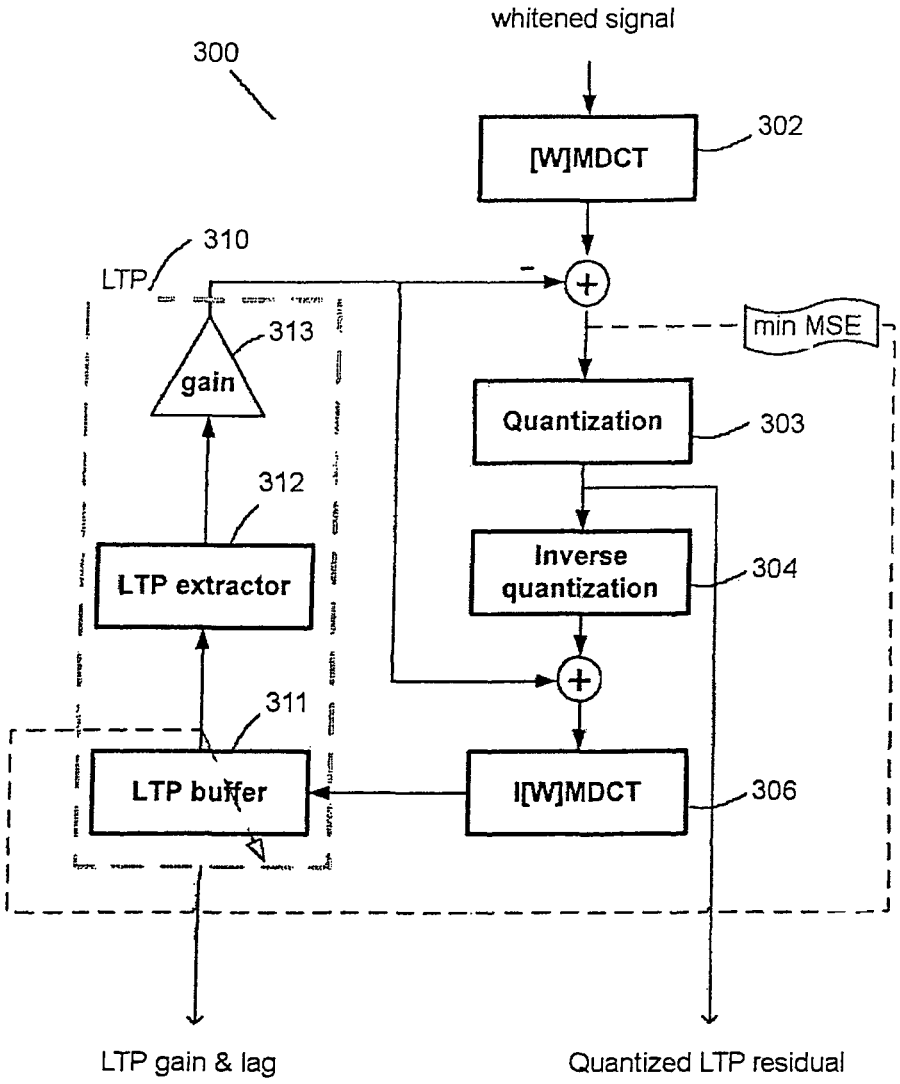
FIG. 3 illustrates another embodiment of the encoder according to the present invention.

In FIG. 3 parts of the encoder 300 are described schematically in more detail. The whitened signal as output from the LPC module 201 in the encoder of FIG. 2 is input to the MDCT filterbank 302. The MDCT analysis may optionally be a time-warped MDCT analysis that ensures that the pitch of the signal (if the signal is periodic with a well-defined pitch) is constant over the MDCT transform window.

In FIG. 3 the LTP module 310 is outlined in more detail. It comprises a LTP buffer 311 holding reconstructed time-domain samples of the previous output signal segments. A LTP extractor 312 finds the best matching segment in the LTP buffer 311 given the current input segment. A suitable gain value is applied to this segment by gain unit 313 before it is subtracted from the segment currently being input to the quantizer 303. Evidently, in order to do the subtraction prior to quantization, the LTP extractor 312 also transforms the chosen signal segment to the MDCT-domain. The LTP extractor 312 searches for the best gain and lag values that minimize an error function in the perceptual domain when combining the reconstructed previous output signal segment with the transformed MDCT-domain input frame. For instance, a mean squared error (MSE) function between the transformed reconstructed segment from the LTP module 310 and the transformed input frame (i.e. the residual signal after the subtraction) is optimized. This optimization may be performed in a perceptual domain where frequency components (i.e. MDCT lines) are weighted according to their perceptual importance. The LTP module 310 operates in MDCT frame units and the encoder 300 considers one MDCT frame residual at a time, for instance for quantization in the quantization module 303. The lag and gain search may be performed in a perceptual domain. Optionally, the LTP may be frequency selective, i.e. adapting the gain and/or lag over frequency. An inverse quantization unit 304 and an inverse MDCT unit 306 are depicted. The MDCT may be time-warped as explained later.

Figure 4:
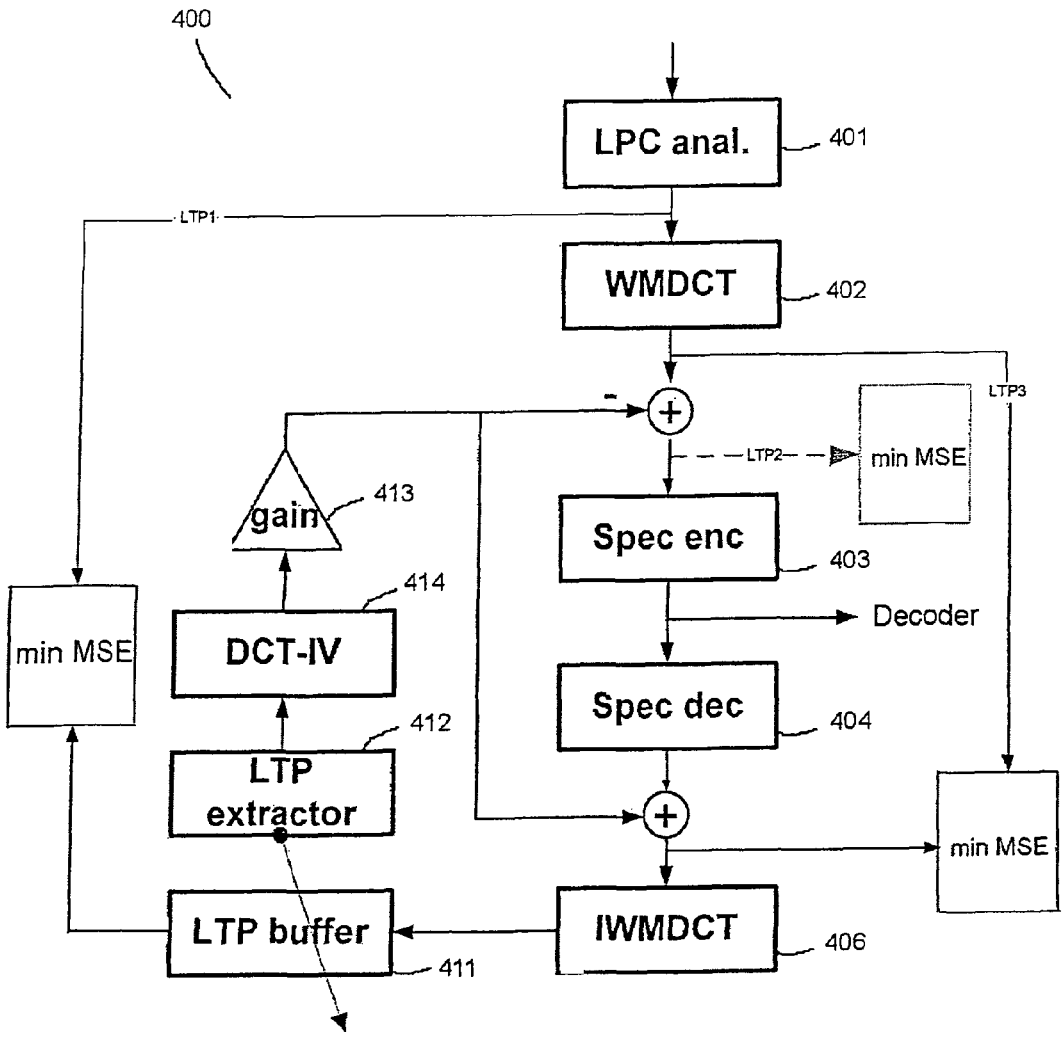
FIG. 4 illustrates a preferred embodiment of the encoder according to the present invention.

In FIG. 4 another embodiment of the encoder 400 is illustrated. In addition to FIG. 3, the LPC analysis 401 is included for clarification. A DCT-IV transform 414 used to transform a selected signal segment to the MDCT-domain is shown. Additionally, several ways of calculating the minimum error for the LTP segment selection are illustrated. In addition to the minimization of the residual signal as shown in FIG. 4 (identified as LTP2 in FIG. 4), the minimization of the difference between the transformed input signal and the de-quantized MDCT-domain signal before being inversely transformed to a reconstructed time-domain signal for storage in the LTP buffer 411 is illustrated (indicated as LTP3). Minimization of this MSE function will direct the LTP contribution towards an optimal (as possible) similarity of transformed input signal and reconstructed input signal for storage in the LTP buffer 411. Another alternative error function (indicated as LTP1) is based on the difference of these signals in the time-domain. In this case, the MSE between LPC filtered input frame and the corresponding time-domain reconstruction in the LTP buffer 411 is minimized. The MSE is advantageously calculated based on the MDCT frame size, which may be different from the LPC frame size. Additionally, the quantizer and de-quantizer blocks are replaced by the spectrum encoding block 403 and the spectrum decoding blocks 404 ("Spec enc" and "Spec dec") that may contain additional modules apart from quantization as will be outlined in FIG. 6. Again, the MDCT and inverse MDCT may be time-warped (WMDCT, IWMDCT).

Figure 5:
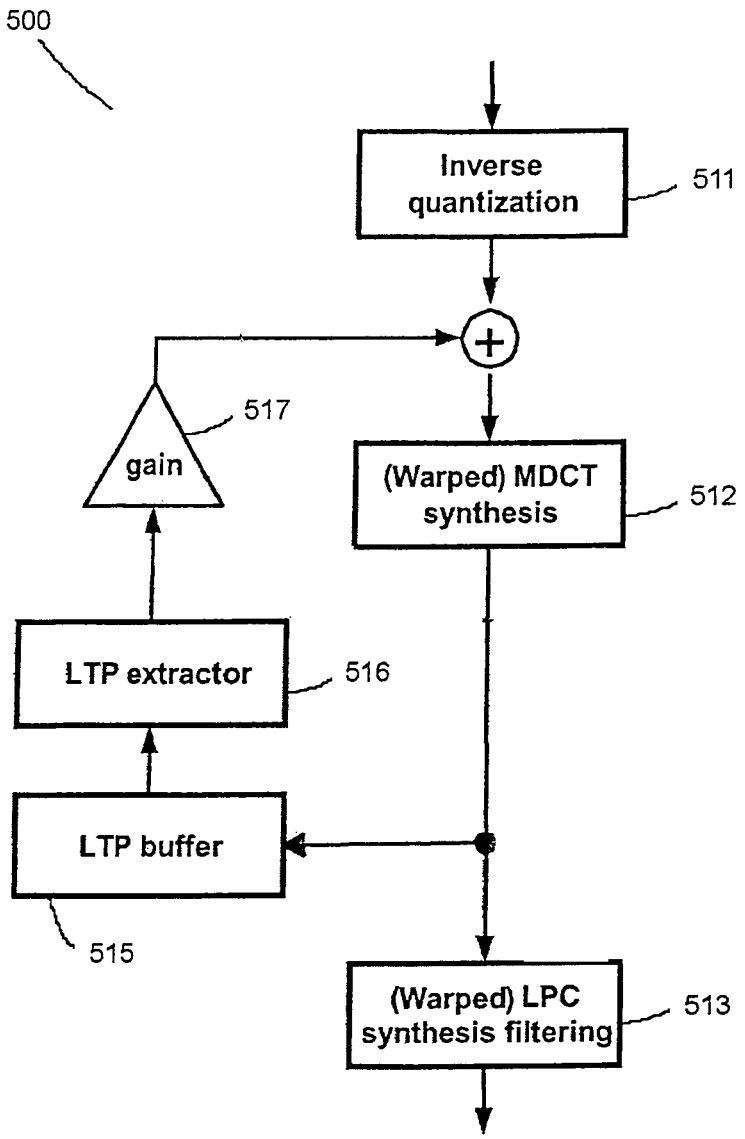
FIG. 5 illustrates a preferred embodiment of the decoder according to the present invention.

In FIG. 5 a proposed decoder 500 is illustrated. The spectrum data from the received bitstream is inversely quantized 511 and added with a LTP contribution provided by a LTP extractor from a LTP buffer 515. LTP extractor 516 and LTP gain unit 517 in the decoder 500 are illustrated, too. The summed MDCT lines are synthesized to the time-domain by a MDCT synthesis block, and the time-domain signal is spectrally shaped by a LPC synthesis filter 513.

Figure 6:
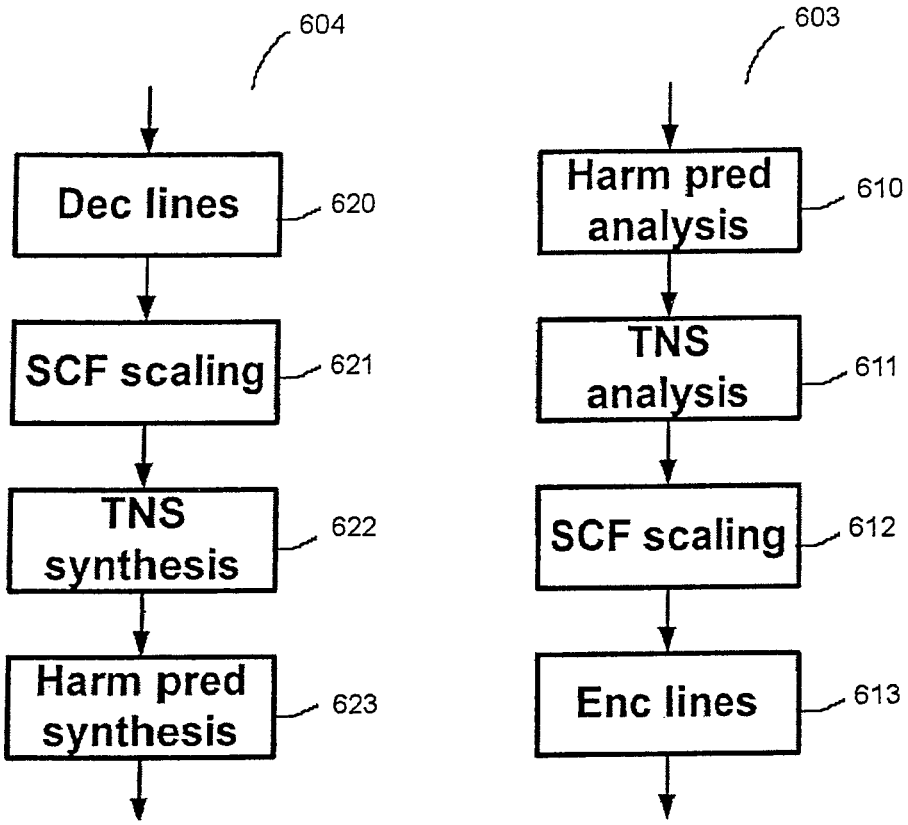
FIG. 6 illustrates a preferred embodiment of the MDCT lines encoding and decoding according to the present invention.

In FIG. 6 the "Spec dec" and "Spec enc" blocks 403, 404 of FIG. 4 are described in more detail. The "Spec enc" block 603 illustrated to the right in the figure comprises in an embodiment an Harmonic Prediction analysis module 610, a TNS analysis (Temporal Noise Shaping) module 611, followed by a scale-factor scaling module 612 of the MDCT lines, and finally quantization and encoding of the lines in a Enc lines module 613. The decoder "Spec Dec" block 604 illustrated to the left in the figure does the inverse process, i.e. the received MDCT lines are de-quantized in a Dec lines module 620 and the scaling is un-done by a scalefactor (SCF) scaling module 621. TNS synthesis 622 and Harmonic prediction synthesis 623 are applied.

Figure 7:
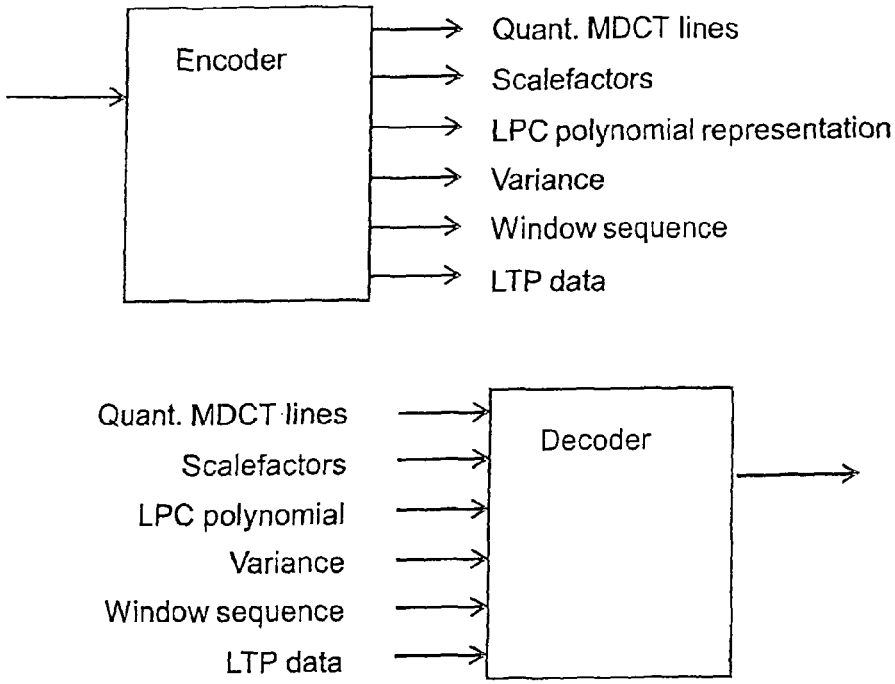
FIG. 7 illustrates a preferred embodiment of the encoder and decoder, and examples of relevant control data transmitted from one to the other, according to the present invention.

In FIG. 7 a very general illustration of the inventive coding system is outlined. The exemplary encoder takes the input signal and produces a bitstream containing, among other data:

quantized MDCT lines;
scalefactors;
LPC polynomial representation;
signal segment energy (e.g. signal variance);
window sequence;
LTP data.

The decoder according to the embodiment reads the provided bitstream and produces an audio output signal, psychoacoustically resembling the original signal.

Figure 7A:
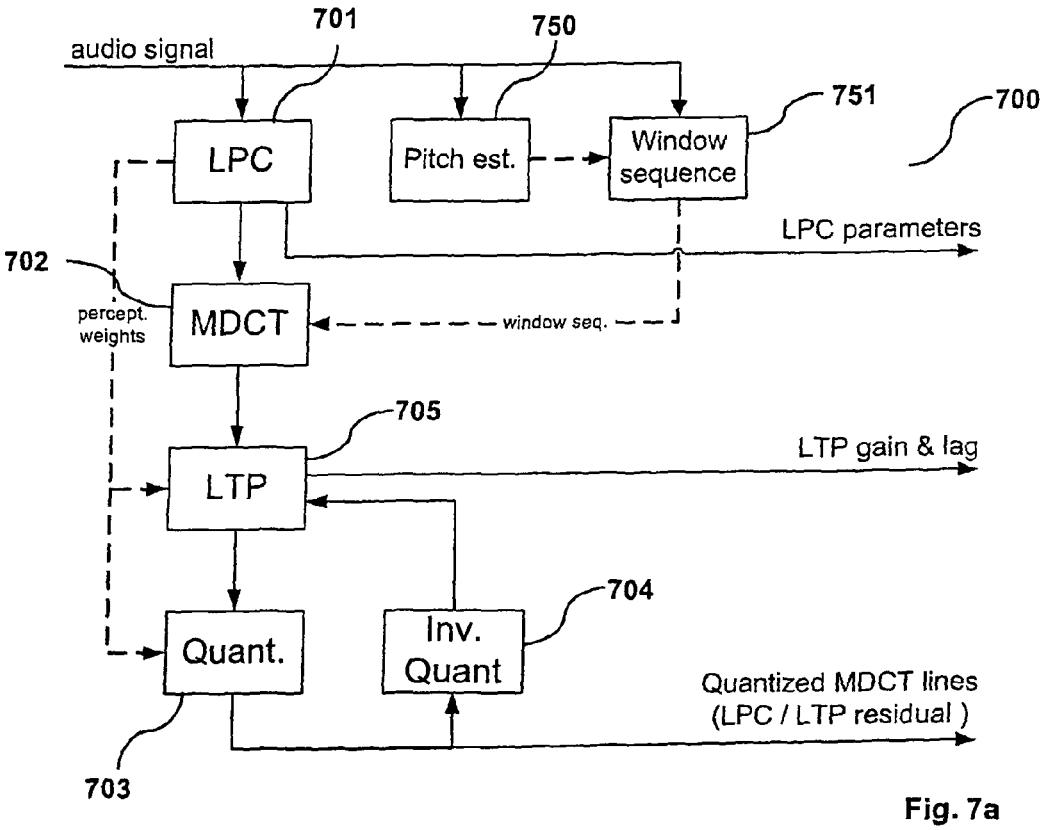
FIG. 7*a* is another illustration of aspects of the encoder according to an embodiment of the invention.

FIG. 7*a* is another illustration of aspects of an encoder 700 according to an embodiment of the invention. The encoder 700 comprises an LPC module 701, a MDCT module 704, a LTP module 705 (shown only simplified), a quantization module 703 and an inverse quantization module 704 for) feeding back reconstructed signals to the LTP module 705. Further provided are a pitch estimation module 750 for estimating the pitch of the input signal, and a window sequence determination module 751 for determining the optimal MDCT window sequence for a larger block of the input signal (e.g. 1 second). In this embodiment, the MDCT window sequence is determined based on an open-loop approach where sequence of MDCT window size candidates is determined that minimizes a coding cost function, e.g. a simplistic perceptual entropy. The contribution of the LTP module 705 to the coding cost function that is minimized by the window sequence determination module 751 may optionally be considered when searching for the optimal MDCT window sequence. Preferably, for each evaluated window size candidate, the best long term prediction contribution to the MDCT frame corresponding to the window size candidate is determined, and the respective coding cost is estimated. In general, short MDCT frame sizes are more appropriate for speech input while long transform windows having a fine spectral resolution are preferred for audio signals.

Perceptual weights or a perceptual weighting function are determined based on the LPC parameters as calculated by the LPC module 701, which will be explained in more detail below. The perceptual weights are supplied to the LTP module 705 and the quantization module 703, both operating in the MDCT-domain, for weighting error or distortion contributions of frequency components according to their respective perceptual importance. FIG. 7*a* further illustrates which coding parameters are transmitted to the decoder, preferably by an appropriate coding scheme as will be discussed later.

Next, the coexistence of LPC and MDCT data and the emulation of the effect of the LPC in the MDCT, both for counteraction and actual filtering omission, will be discussed.

According to an embodiment, the LP module filters the input signal so that the spectral shape of the signal is removed, and the subsequent output of the LP module is a spectrally flat signal. This is advantageous for the operation of, e.g., the LTP. However, other parts of the codec operating on the spectrally flat signal may benefit from knowing what the spectral shape of the original signal was prior to LP filtering. Since the encoder modules, after the filtering, operate on the MDCT transform of the spectrally flat signal, the present invention teaches that the spectral shape of the original signal prior to LP filtering can, if needed, be re-imposed on the MDCT representation of the spectrally flat signal by mapping the transfer function of the used LP filter (i.e. the spectral envelope of the original signal) to a gain curve, or equalization curve, that is applied on the frequency bins of the MDCT representation of the spectrally flat signal. Conversely, the LP module can omit the actual filtering, and only estimate a transfer function that is subsequently mapped to a gain curve which can be imposed on the MDCT representation of the signal, thus removing the need for time domain filtering of the input signal.

One prominent aspect of embodiments of the present invention is that an MDCT-based transform coder is operated using a flexible window segmentation, on a LPC whitened signal. This is outlined in FIG. 8, where an exemplary MDCT window sequence is given, along with the windowing of the LPC. Hence, as is clear from the figure, the LPC operates on a constant frame-size (e.g. 20 ms), while the MDCT operates on a variable window sequence (e.g. 4 to 128 ms). This allows for choosing the optimal window length for the LPC and the optimal window sequence for the MDCT independently.

Figure 8:
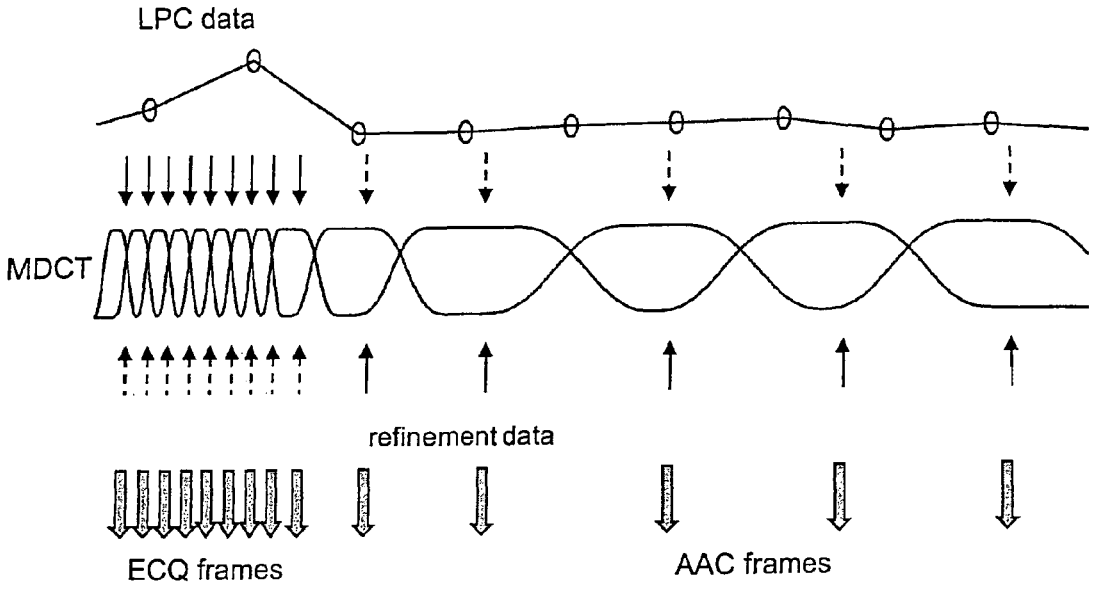
FIG. 8 illustrates an example of a window sequence and the relation between LPC data and MDCT data according to an embodiment of the present invention.

FIG. 8 further illustrates the relation between LPC data, in particular the LPC parameters, generated at a first frame rate and MDCT data, in particular the MDCT lines, generated at a second variable rate. The downward arrows in the figure symbolize LPC data that is interpolated between the LPC frames (circles) so as to match corresponding MDCT frames. For instance, a LPC-generated perceptual weighting function is interpolated for time instances as determined by the MDCT window sequence.

The upward arrows symbolize refinement data (i.e. control data) used for the MDCT lines coding. For the AAC frames this data is typically scalefactors, and for the ECQ frames the data is typically variance correction data etc. The solid vs dashed lines represent which data is the most "important" data for the MDCT lines coding given a certain quantizer. The double downward arrows symbolize the codec spectral lines.

The coexistence of LPC and MDCT data in the encoder may be exploited, for instance, to reduce the bit requirements of encoding MDCT scalefactors by taking into account a perceptual masking curve estimated from the LPC parameters. Furthermore, LPC derived perceptual weighting may be used when determining quantization distortion. As illustrated and as will be discussed below, the quantizer operates in two modes and generates two types of frames (ECQ frames and AAC frames) depending on the frame size of received data, i.e. corresponding to the MDCT frame or window size.

Figure 11:
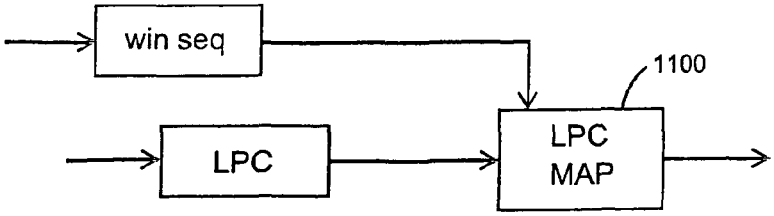
FIG. 11 illustrates a preferred embodiment of mapping the constant update rate LPC parameters to the adaptive MDCT window sequence data, according to the present invention.

FIG. 11 illustrates a preferred embodiment of mapping the constant rate LPC parameters to adaptive MDCT window sequence data. A LPC mapping module 1100 receives the LPC parameters according to the LPC update rate. In addition, the LPC mapping module 1100 receives information on the MDCT window sequence. It then generates a LPC-to-MDCT mapping, e.g., for mapping LPC-based psychoacoustic data to respective MDCT frames generated at the variable MDCT frame rate. For instance, the LPC mapping module interpolates LPC polynomials or related data for time instances corresponding to MDCT frames for usage, e.g., as perceptual weights in LTP module or quantizer.

Figure 9:
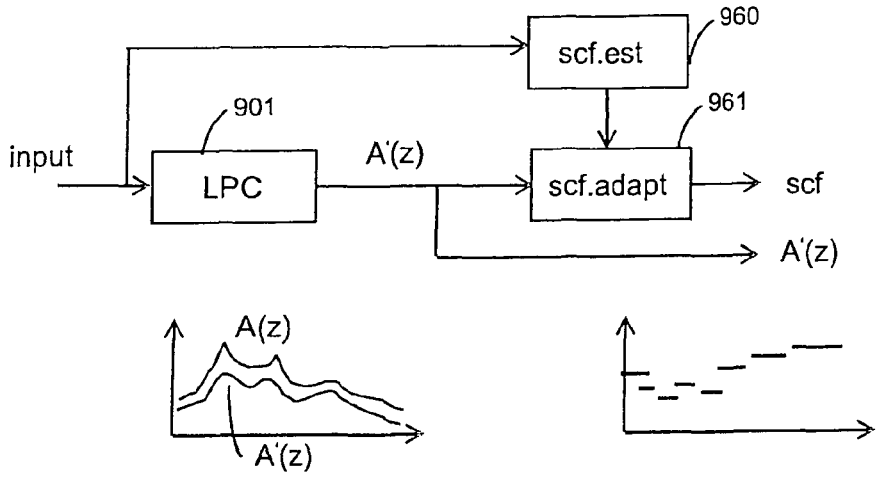
FIG. 9 illustrates a combination of scale-factor data and LPC data according to the present invention.

Now, specifics of the LPC-based perceptual model are discussed by referring to FIG. 9. The LPC module 901 is in an embodiment of the present invention adapted to produce a white output signal, by using linear prediction of, e.g., order 16 for a 16 kHz sampling rate signal. For example, the output from the LPC module 201 in FIG. 2 is the residual after LPC parameter estimation and filtering. The estimated LPC polynomial A(z), as schematically visualized in the lower left of FIG. 9, may be chirped by a bandwidth expansion factor, and also tilted by, in one implementation of the invention, modifying the first reflection coefficient of the corresponding LPC polynomial. Chirping expands the bandwidth of peaks in the LPC transfer function by moving the poles of the polynomial inwards into the unit circle, thus resulting in softer peaks. Tilting allows making the LPC transfer function flatter in order to balance the influence of lower and higher frequencies. These modifications strive to generate a perceptual masking curve A'(z) from the estimated LPC parameters that will be available on both the encoder and the decoder side of the system. Details to the manipulation of the LPC polynomial are presented in FIG. 12 below.

The MDCT coding operating on the LPC residual has, in one implementation of the invention, scalefactors to control the resolution of the quantizer or the quantization step sizes (and, thus, the noise introduced by quantization). These scalefactors are estimated by a scalefactor estimation module 960 on the original input signal. For example, the scalefactors are derived from a perceptual masking threshold curve estimated from the original signal. In an embodiment, a separate frequency transform (having possibly a different frequency resolution) may be used to determine the masking threshold curve, but this is not always necessary. Alternatively, the masking threshold curve is estimated from the MDCT lines generated by the transformation module. The bottom right part of FIG. 9 schematically illustrates scalefactors generated by the scalefactor estimation module 960 to control quantization so that the introduced quantization noise is limited to inaudible distortions.

If a LPC filter is connected upstream of the MDCT transformation module, a whitened signal is transformed to the MDCT-domain. As this signal has a white spectrum, it is not well suited to derive a perceptual masking curve from it. Thus, a MDCT-domain equalization gain curve generated to compensate the whitening of the spectrum may be used when estimating the masking threshold curve and/or the scalefactors. This is because the scalefactors need to be estimated on a signal that has absolute spectrum properties of the original signal, in order to correctly estimate perceptually masking. The calculation of the MDCT-domain equalization gain curve from the LPC polynomial is discussed in more detail with reference to FIG. 10 below.

Figure 9A:
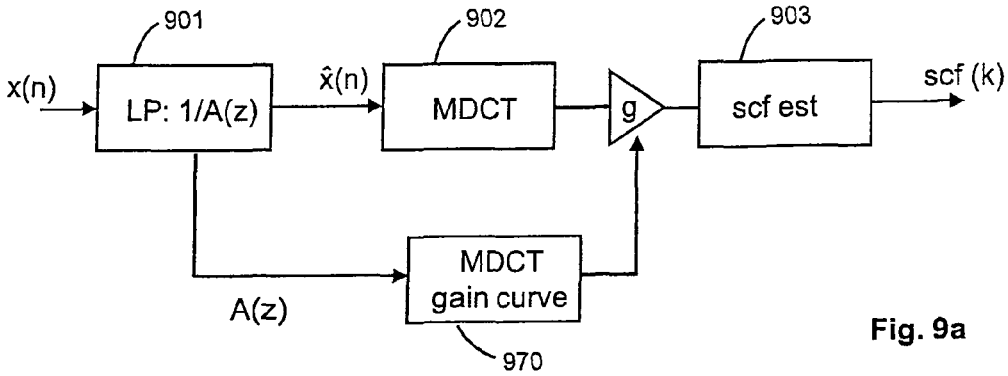
FIG. 9*a* illustrates another embodiment of the combination of scale-factor data and LPC data according to the present invention.

An embodiment of the above outlined scalefactor estimation schema is outlined in FIG. 9*a*. In this embodiment, the input signal is input to the LP module 901 that estimates the spectral envelope of the input signal described by A(z), and outputs said polynomial as well as a filtered version of the input signal. The input signal is filtered with the inverse of A(z) in order to obtain a spectrally white signal as subsequently used by other parts of the encoder. The filtered signal $\hat{x}(n)$ is input to a MDCT transformation unit 902, while the A(z) polynomial is input to a MDCT gain curve calculation unit 970 (as outlined in FIG. 14). The gain curve estimated from the LP polynomial is applied to the MDCT coefficients or lines in order to retain the spectral envelope of the original input signal prior to scalefactor estimation. The gain adjusted MDCT lines are input to the scalefactor estimation module 960 that estimates the scalefactors for the input signal.

Using the above outlined approach, the data transmitted between the encoder and decoder contains both the LP polynomial from which the relevant perceptual information as well as a signal model can be derived when a model-based quantizer is used, and the scalefactors commonly used in a transform codec.

In more detail, returning to FIG. 9, the LPC module 901 in the figure estimates from the input signal a spectral envelope A(z) of the signal and derives from this a perceptual representation A'(z). In addition, scalefactors as normally used in transform based perceptual audio codecs are estimated on the input signal, or they may be estimated on the white signal produced by a LP filter, if the transfer function of the LP filter is taken into account in the scalefactor estimation (as described in the context of FIG. 10 below). The scalefactors may then be adapted in scalefactor adaptation module 961 given the LP polynomial, as will be outlined below, in order to reduce the bit rate required to transmit scalefactors.

Normally, the scalefactors are transmitted to the decoder, and so is the LP polynomial. Now, given that they are both estimated from the original input signal and that they both are somewhat correlated to the absolute spectrum properties of the original input signal, it is proposed to code a delta representation between the two, in order to remove any redundancy that may occur if both were transmitted separately. According to an embodiment, this correlation is exploited as follows. Since the LPC polynomial, when correctly chirped and tilted, strives to represent a masking threshold curve, the two representations may be combined so that the transmitted scalefactors of the transform coder represent the difference between the desired scalefactors and those that can be derived from the transmitted LPC polynomial. The scalefactor adaptation module 961 shown in FIG. 9 therefore calculates the difference between the desired scalefactors generated from the original input signal and the LPC-derived scalefactors. This aspect retains the ability to have a MDCT-based quantizer that has the notion of scalefactors as commonly used in transform coders, within an LPC structure, operating on a LPC residual, and still have the possibility to switch to a model-based quantizer that derives quantization step sizes solely from the linear prediction data.

Figure 9B:
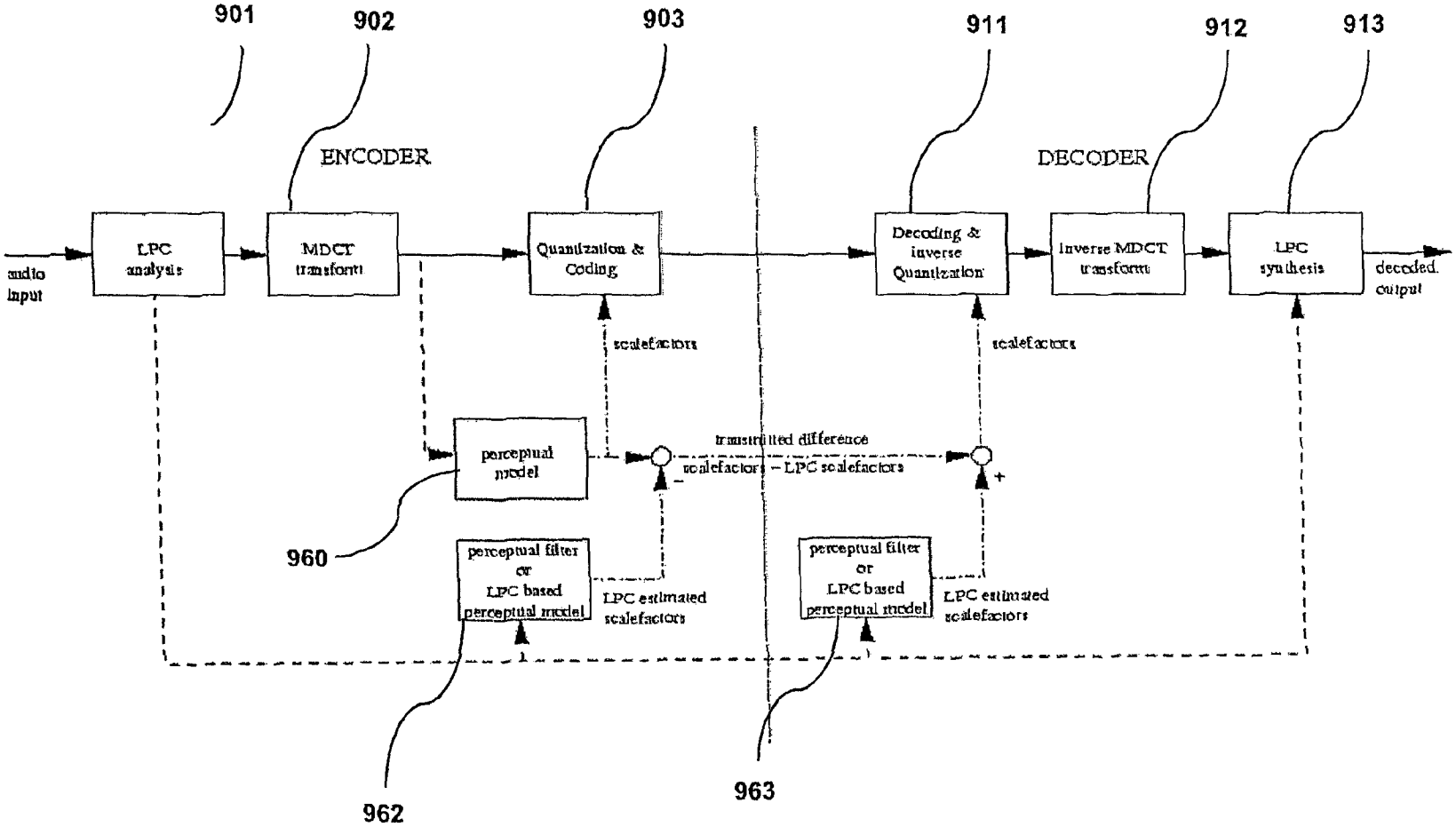
FIG. 9*b* illustrates another simplified block diagram of an encoder and a decoder according to the present invention.

In FIG. 9*b* a simplified block diagram of encoder and decoder according to an embodiment are given. The input signal in the encoder is passed through the LPC module 901 that generates a whitened residual signal and the corresponding linear predication parameters. Additionally, gain normalization may be included in the LPC module 901. The residual signal from the LPC is transformed into the frequency domain by an MDCT transform 902. To the right of FIG. 9*b* the decoder is depicted. The decoder takes the quantized MDCT lines, de-quantizes 911 them, and applies an inverse MDCT transform 912, followed by an LPC synthesis filter 913.

The whitened signal as output from the LPC module 901 in the encoder of FIG. 9*b* is input to the MDCT filterbank 902. The MDCT lines as result of the MDCT analysis are transform coded with a transform coding algorithm consisting of a perceptual model that guides the desired quantization step size for different parts of the MDCT spectrum. The values determining the quantization step size are called scalefactors and there is one scalefactor value needed for each partition, named scalefactor band, of the MDCT spectrum. In prior art transform coding algorithms, the scalefactors are transmitted via the bitstream to the decoder.

According to one aspect of the invention, the perceptual masking curve estimated from the LPC parameters, as explained with reference to FIG. 9, is used when encoding the scalefactors used in quantization. Another possibility to estimate a perceptual masking curve is to use the unmodified LPC filter coefficients for an estimation of the energy distribution over the MDCT lines. With this energy estimation, a psychoacoustic model, as used in transform coding schemes, can be applied in both encoder and decoder to obtain an estimation of a masking curve.

The two representations of a masking curve are then combined so that the scalefactors to be transmitted of the transform coder represent the difference between the desired scalefactors and those that can be derived from the transmitted LPC polynomial or LPC-based psychoacoustic model. This feature retains the ability to have a MDCT-based quantizer that has the notion of scalefactors as commonly used in transform coders, within a LPC structure, operating on a LPC residual, and still have the possibility to control quantization noise on a per scalefactor band basis according to the psychoacoustic model of the transform coder. The advantage is that transmitting the difference of the scalefactors will cost less bits compared to transmitting the absolute scalefactor values without taking the already present LPC data into account. Depending on bit rate, frame size or other parameters, the amount of scalefactor residual to be transmitted may be selected. For having full control of each scalefactor band, a scalefactor delta may be transmitted with an appropriate noiseless coding scheme. In other cases, the cost for transmitting scalefactors can be reduced further by a coarser representation of the scalefactor differences. The special case with lowest overhead is when the scalefactor difference is set to 0 for all bands and no additional information is transmitted.

Figure 10:
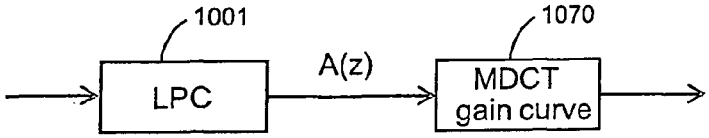
FIG. 10 illustrates a preferred embodiment of translating LPC polynomials to a MDCT gain curve according to the present invention.

FIG. 10 illustrates a preferred embodiment of translating LPC polynomials into a MDCT gain curve. As outlined in FIG. 2, the MDCT operates on a whitened signal, whitened by the LPC filter 1001. In order to retain the spectral envelope of the original input signal, a MDCT gain curve is calculated by the MDCT gain curve module 1070. The MDCT-domain equalization gain curve may be obtained by estimating the magnitude response of the spectral envelope described by the LPC filter, for the frequencies represented by the bins in the MDCT transform. The gain curve may then be applied on the MDCT data, e.g., when calculating the minimum mean square error signal as outlined in FIG. 3, or when estimating a perceptual masking curve for scalefactor determination as outlined with reference to FIG. 9 above.

Figure 12:
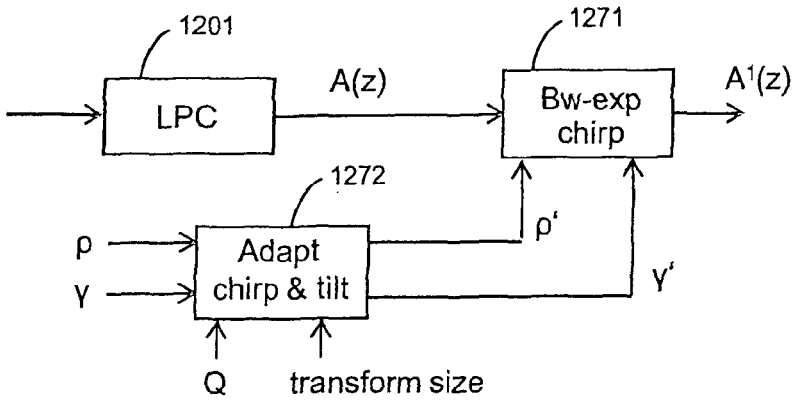
FIG. 12 illustrates a preferred embodiment of adapting the perceptual weighting filter calculation based on transform size and type of quantizer, according to the present invention.

FIG. 12 illustrates a preferred embodiment of adapting the perceptual weighting filter calculation based on transform size and/or type of quantizer. The LP polynomial A(z) is estimated by the LPC module 1201 in FIG. 16. A LPC parameter modification module 1271 receives LPC parameters, such as the LPC polynomial A(z), and generates a perceptual weighting filter A'(z) by modifying the LPC parameters. For instance, the bandwidth of the LPC polynomial A(z) is expanded and/or the polynomial is tilted. The input parameters to the adapt chirp & tilt module 1272 are the default chirp and tilt values $\rho$ and $\gamma$. These are modified given predetermined rules, based on the transform size used, and/or the quantization strategy Q used. The modified chirp and tilt parameters $\rho'$ and $\gamma'$ are input to the LPC parameter modification module 1271 translating the input signal spectral envelope, represented by A(z), to a perceptual masking curve represented by A'(z).

Figure 13:
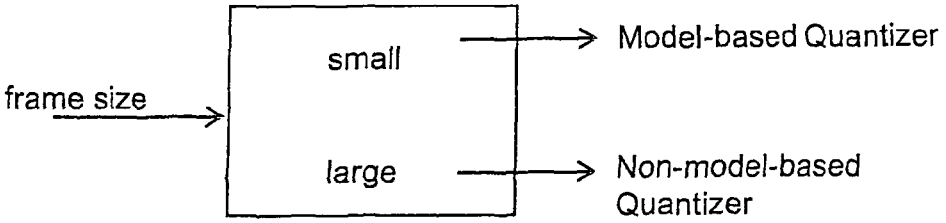
FIG. 13 illustrates a preferred embodiment of adapting the quantizer dependent on the frame size, according to the present invention.

In the following, the quantization strategy conditioned on frame-size, and the model-based quantization conditioned on assorted parameters according to an embodiment of the invention will be explained. One aspect of the present invention is that it utilizes different quantization strategies for different transform sizes or frame sizes. This is illustrated in FIG. 13, where the frame size is used as a selection parameter for using a model-based quantizer or a non-model-based quantizer. It must be noted that this quantization aspect is independent of other aspects of the disclosed encoder/decoder and may be applied in other codecs as well. An example of a non-model-based quantizer is Huffman table based quantizer used in the AAC audio coding standard. The model-based quantizer may be an Entropy Constraint Quantizer (ECQ) employing arithmetic coding. However, other quantizers may be used in embodiments of the present invention as well.

According to an independent aspect of the present invention, it is suggested to switch between different quantization strategies as function of frame size in order to be able to use the optimal quantization strategy given a particular frame size. As an example, the window-sequence may dictate the usage of a long transform for a very stationary tonal music segment of the signal. For this particular signal type, using a long transform, it is highly beneficial to employ a quantization strategy that can take advantage of "sparse" character (i.e. well defined discrete tones) in the signal spectrum. A quantization method as used in AAC in combination with Huffman tables and grouping of spectral lines, also as used in AAC, is very beneficial. However, and on the contrary, for speech segments, the window-sequence may, given the coding gain of the LTP, dictate the usage of short transforms. For this signal type and transform size it is beneficial to employ a quantization strategy that does not try to find or introduce sparseness in the spectrum, but instead maintains a broadband energy that, given the LTP, will retain the pulse like character of the original input signal.

Figure 14:
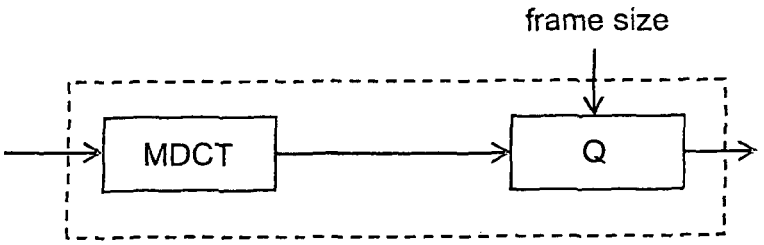
FIG. 14 illustrates a preferred embodiment of adapting the quantizer dependent on the frame size, according to the present invention.

A more general visualization of this concept is given in FIG. 14, where the input signal is transformed into the MDCT-domain, and subsequently quantized by a quantizer controlled by the transform size or frame size used for the MDCT transform.

Figure 15:
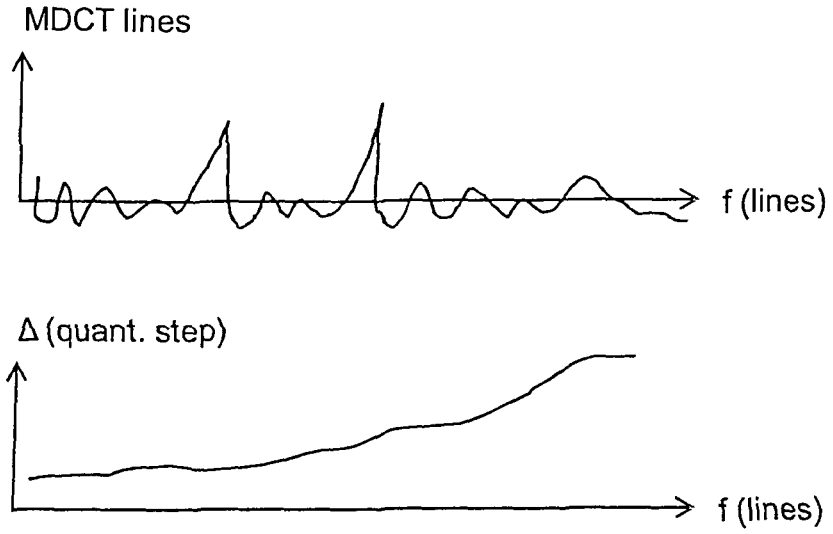
FIG. 15 illustrates a preferred embodiment of adapting the quantization step size as a function of LPC and LTP data, according to the present invention.
Figure 15A:
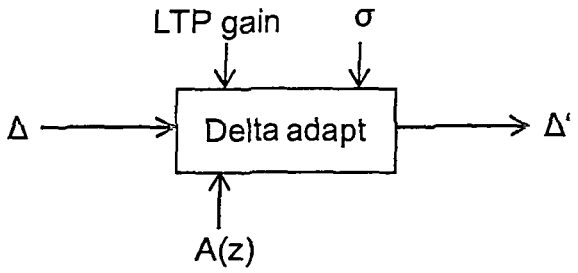
FIG. 15*a* illustrates how a delta-curve is derived from LPC and LTP parameters by means of a delta-adapt module.

According to another aspect of the invention, the quantizer step size is adapted as function of LPC and/or LTP data. This allows a determination of the step size depending on the difficulty of a frame and controls the number of bits that are allocated for encoding the frame. In FIG. 15 an illustration is given on how model-based quantization may be controlled by LPC and LTP data. In the top part of FIG. 15, a schematic visualization of MDCT lines is given. Below the quantization step size delta A as a function of frequency is depicted. It is clear from this particular example that the quantization step size increases with frequency, i.e. more quantization distortion is incurred for higher frequencies. The delta-curve is derived from the LPC and LTP parameters by means of a delta-adapt module depicted in FIG. 15*a*. The delta curve may further be derived from the prediction polynomial A(z) by chirping and/or tilting as explained with reference to FIG. 13.

A preferred perceptual weighting function derived from LPC data is given in the following equation:

$$P(z) = \frac{1-(1-\tau)r_1 z^{-1}}{A(z/\rho)}$$

where A(z) is the LPC polynomial, $\tau$ is a tilting parameter, $\rho$ controls the chirping and $r_1$ is the first reflection coefficient calculated from the A(z) polynomial. It is to be noted that the A(z) polynomial can be re-calculate to an assortment of different representations in order to extract relevant information from the polynomial. If one is interested in the spectral slope in order to apply a "tilt" to counter the slope of the spectrum, re-calculation of the polynomial to reflection coefficients is preferred, since the first reflection coefficient represents the slope of the spectrum.

In addition, the delta values $\Delta$ may be adapted as a function of the input signal variance $\sigma$, the LTP gain g, and the first reflection coefficient $r_1$ derived from the prediction polynomial. For instance, the adaptation may be based on the following equation:

$$\Delta' = \Delta(1 + r_1(1 - g^2))$$

Figure 16:
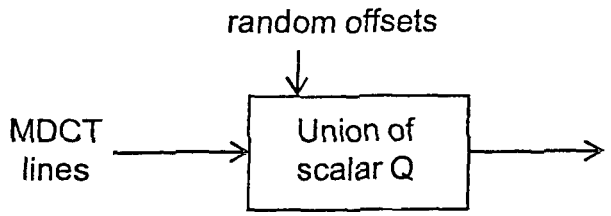
FIG. 16 illustrates a preferred embodiment of a model-based quantizer utilizing random offsets, according to the present invention.

In the following, aspects of a model-based quantizers according to an embodiment of the present invention are outlined. In FIG. 16 one of the aspects of the model-based quantizer is visualized. The MDCT lines are input to a quantizer employing uniform scalar quantizers. In addition, random offsets are input to the quantizer, and used as offset values for the quantization intervals shifting the interval borders. The proposed quantizer provides vector quantization advantages while maintaining searchability of scalar quantizers. The quantizer iterates over a set of different offset values, and calculates the quantization error for these. The offset value (or offset value vector) that minimizes the quantization distortion for the particular. MDCT lines being quantized is used for quantization. The offset value is then transmitted to the decoder along with the quantized MDCT lines. The use of random offsets introduces noise-filling in the de-quantized decoded signal and, by doing so, avoids spectral holes in the quantized spectrum. This is particularly important for low bit rates where many MDCT lines are otherwise quantized to a zero value which would lead to audible holes in the spectrum of the reconstructed signal.

Figure 17:
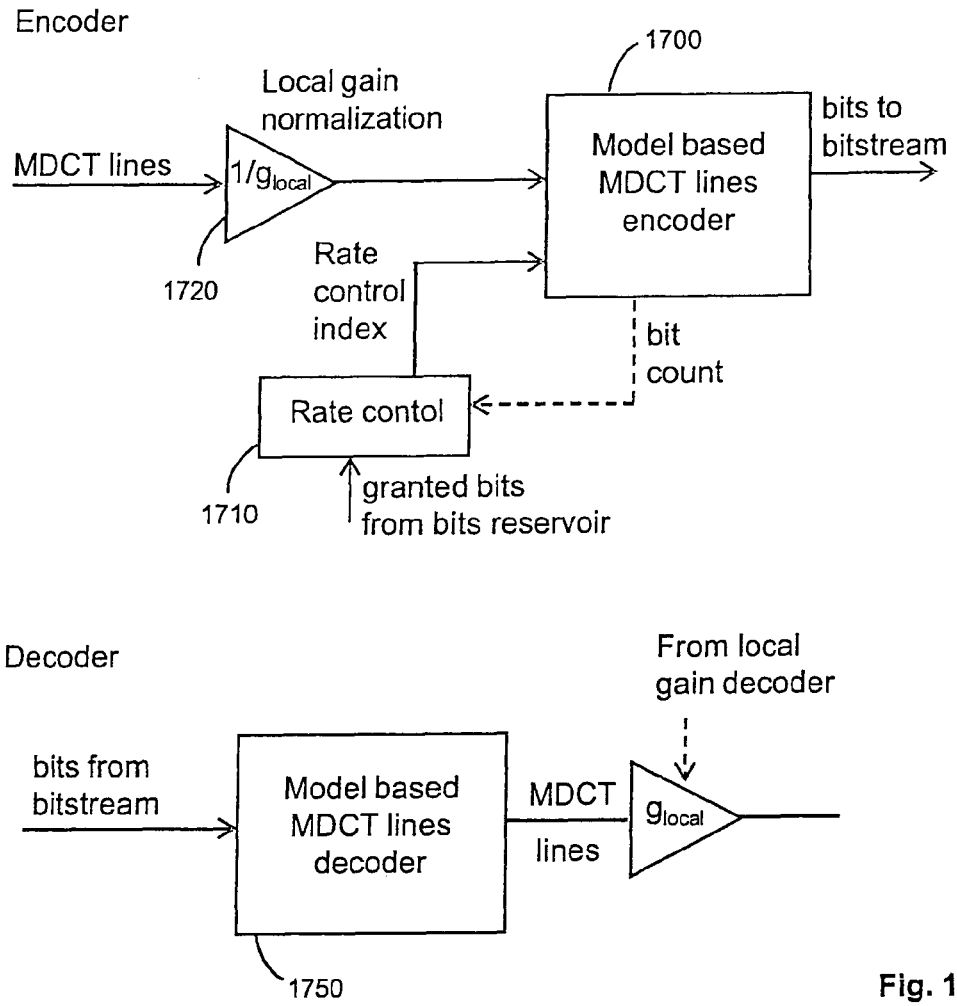
FIG. 17 illustrates a preferred embodiment of a model-based quantizer according to the present invention.

FIG. 17 illustrates schematically a Model-based MDCT Lines Quantizer (MBMLQ) according to an embodiment of the invention. The top of FIG. 17 depicts a MBMLQ encoder 1700. The MBMLQ encoder 1700 takes as input the MDCT lines in an MDCT frame or the MDCT lines of the LTP residual if an LTP is present in the system. The MBMLQ employs statistical models of the MDCT lines, and source codes are adapted to signal properties on an MDCT frame-by-frame basis yielding efficient compression to a bitstream.

A local gain of the MDCT lines may be estimated as the RMS value of the MDCT lines, and the MDCT lines normalized in gain normalization module 1720 before input to the MBMLQ encoder 1700. The local gain normalizes the MDCT lines and is a complement to the LP gain normalization. Whereas the LP gain adapts to variations in signal level on a larger time scale, the local gain adapts to variations on a smaller time scale, yielding improved quality of transient sounds and on-sets in speech. The local gain is encoded by fixed rate or variable rate coding and transmitted to the decoder.

A rate control module 1710 may be employed to control the number of bits used to encode an MDCT frame. A rate control index controls the number of bits used. The rate control index points into a list of nominal quantizer step sizes. The table may be sorted with step sizes in descending order (see FIG. 17*g*).

The MBMLQ encoder is run with a set of different rate control indices, and the rate control index that yields a bit count which is lower than the number of granted bits given by the bit reservoir control, is used for the frame. The rate control index varies slowly and this can be exploited to reduce search complexity and to encode the index efficiently. The set of indices that is tested can be reduced if testing is started around the index of the previous MDCT frame. Likewise, efficient entropy coding of the index is obtained if the probabilities peak around the previous value of the index. E.g., for a list of 32 step sizes, the rate control index can be coded using 2 bits per MDCT frame on the average.

FIG. 17 further illustrates schematically the MBMLQ decoder 1750 where the MDCT frame is gain renormalized if a local gain was estimated in the encoder 1700.

Figure 17A:
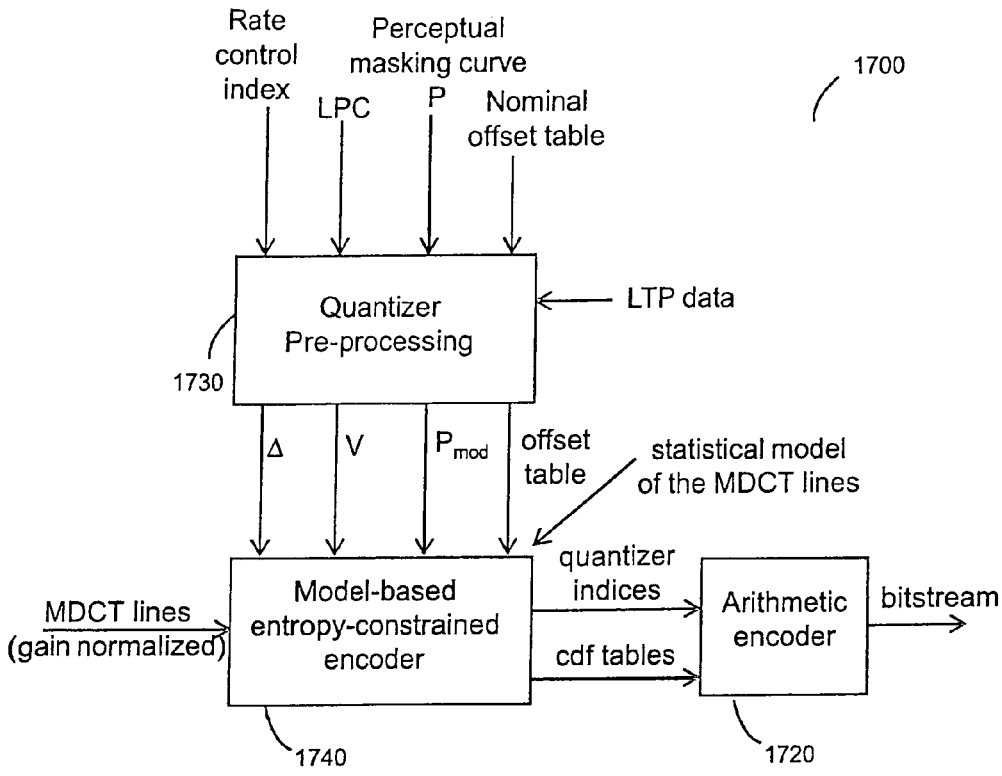
FIG. 17*a* illustrates a another preferred embodiment of a model-based quantizer according to the present invention.

FIG. 17*a* illustrates schematically the model-based MDCT lines encoder 1700 according to an embodiment in more detail. It comprises a quantizer pre-processing module 1730 (see FIG. 17*c*), a model-based entropy-constrained encoder 1740 (see FIG. 17*e*), and an arithmetic encoder 1720 which may be a prior art arithmetic encoder. The task of the quantizer pre-processing module 1730 is to adapt the MBMLQ encoder to the signal statistics, on an MDCT frame-by-frame basis. It takes as input other codec parameters and derives from them useful statistics about the signal that can be used to modify the behavior of the model-based entropy-constrained encoder 1740. The model-based entropy-constrained encoder 1740 is controlled, e.g., by a set of control parameters: a quantizer step size $\Delta$ (delta, interval length), a set of variance estimates of the MDCT lines V (a vector; one estimated value per MDCT line), a perceptual masking curve $P_{mod}$, a matrix or table of (random) offsets, and a statistical model of the MDCT lines that describe the shape of the distribution of the MDCT lines and their inter-dependencies. All the above mentioned control parameters can vary between MDCT frames.

Figure 17B:
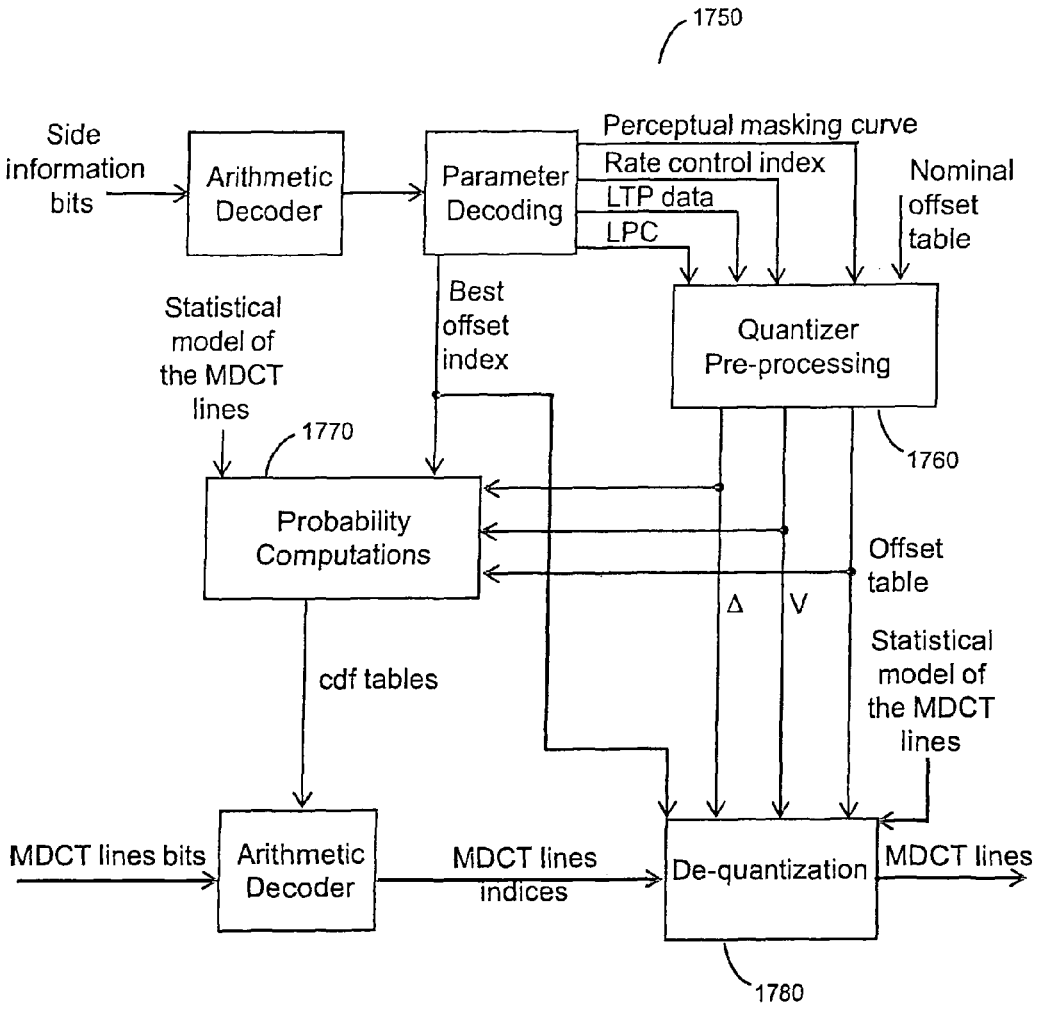
FIG. 17*b* illustrates schematically a model-based MDCT lines decoder 2150 according to an embodiment of the invention.

FIG. 17*b* illustrates schematically a model-based MDCT lines decoder 1750 according to an embodiment of the invention. It takes as input side information bits from the bitstream and decodes those into parameters that are input to the quantizer pre-processing module 1760 (see FIG. 17*c*). The quantizer pre-processing module 1760 has preferably the exact same functionality in the encoder 1700 as in the decoder 1750. The parameters that are input to the quantizer pre-processing module 1760 are exactly the same in the encoder as in the decoder. The quantizer pre-processing module 1760 outputs a set of control parameters (same as in the encoder 1700) and these are input to the probability computations module 1770 (see FIG. 17*g*; same as in encoder, see FIG. 17*e*) and to the de-quantization module 1780 (see FIG. 17*h*; same as in encoder, see FIG. 17*e*). The cdf tables from the probability computations module 1770, representing the probability density functions for all the MDCT lines given the delta used for quantization and the variance of the signal, are input to the arithmetic decoder (which may be any arithmetic coder as known by those skilled in the artart) which then decodes the MDCT lines bits to MDCT lines indices. The MDCT lines indices are then de-quantized to MDCT lines by the de-quantization module 1780.

Figure 17C:
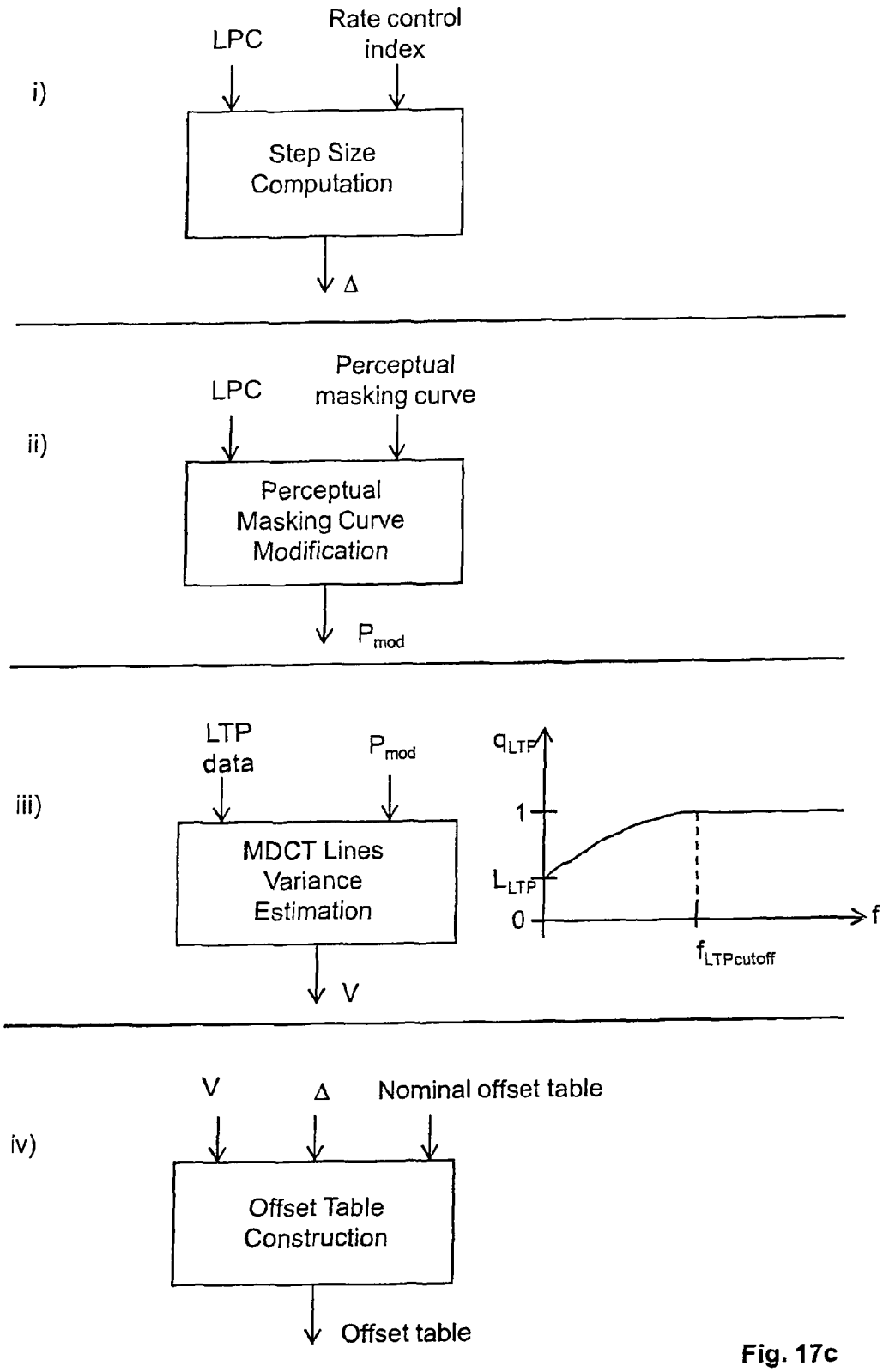
FIG. 17*c* illustrates schematically aspects of quantizer pre-processing according to an embodiment of the invention.

FIG. 17*c* illustrates schematically aspects of quantizer pre-processing according to an embodiment of the invention which consists of i) step size computation, ii) perceptual masking curve modification, iii) MDCT lines variance estimation, iv) offset table construction.

Figure 17D:
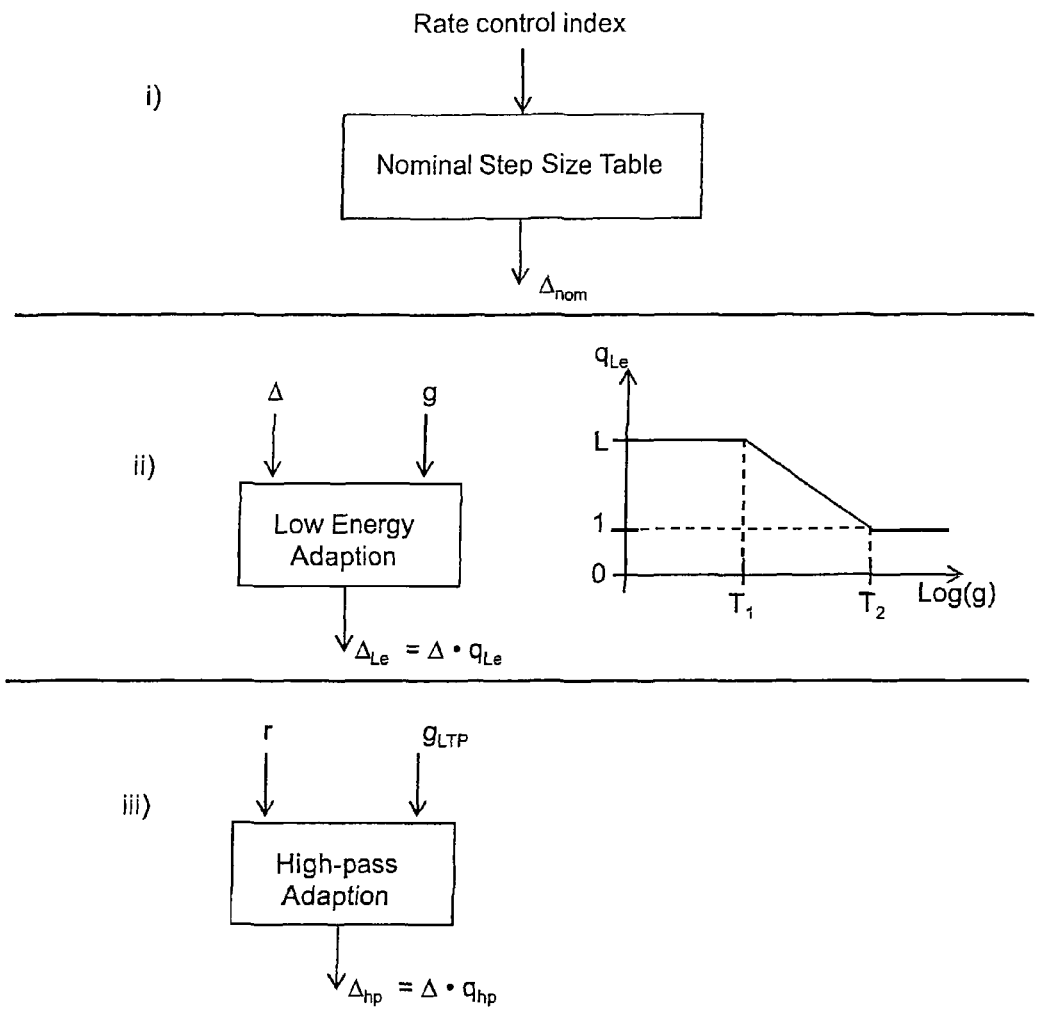
FIG. 17*d* illustrates schematically aspects of the step size computation according to an embodiment of the invention.

The step size computation is explained in more detail in FIG. 17*d*. It comprises i) a table lookup where rate control index points into a table of step sizes produce a nominal step size $\Delta_{nom}$ (delta_nom), ii) low energy adaptation, and high-pass adaptation.

Gain normalization normally results in that high energy sounds and low energy sounds are coded with the same segmental SNR. This can lead to an excessive number of bits being used on low energy sounds. The proposed low energy adaptation allows for fine tuning a compromise between low energy and high energy sounds. The step size may be increased when the signal energy becomes low as depicted in FIG. 17*d-ii*) where an exemplary curve for the relation between signal energy (gain g) and a control factor $q_{Le}$ is shown. The signal gain g may be computed as the RMS value of the input signal itself or of the LP residual. The control curve in FIG. 17*d-ii*) is only one example and other control functions for increasing the step size for low energy signals may be employed. In the depicted example, the control function is determined by step-wise linear sections that are defined by thresholds $T_1$ and $T_2$ and the step size factor L.

High pass sounds are perceptually less important than low pass sounds. The high-pass adaptation function increases the step size when the MDCT frame is high pass, i.e. when the energy of the signal in the present MDCT frame is concentrated to the higher frequencies, resulting in fewer bits spent on such frames. If LTP is present and if the LTP gain $g_{LTP}$ is close to 1, the LTP residual can become high pass; in such a case it is advantageous to not increase the step size. This mechanism is depicted in FIG. 17*d-iii*) where r is the $1^{st}$ reflection coefficient from LPC. The proposed high-pass adaptation may use the following equation:

$$q_{hp} = \begin{cases} 1 + r(1 - g^2) & \text{if } r > 0 \\ 1 & \text{if } r \le 0 \end{cases}$$

FIG. 17*c-ii*) illustrates schematically the perceptual masking curve modification which employs a low frequency (LF) boost to remove "rumble-like" coding artifacts. The LF boost may be fixed or made adaptive so that only a part below the first spectral peak is boosted. The LF boost may be adapted by using the LPC envelope data.

FIG. 17*c-iii*) illustrates schematically the MDCT lines variance estimation. With an LPC whitening filter active, the MDCT lines all have unit variance (according to the LPC envelope). After perceptual weighting in the model-based entropy-constrained encoder 1740 (see FIG. 17*e*), the MDCT lines have variances that are the inverse of the squared perceptual masking curve, or the squared modified masking curve $P_{mod}$. If a LTP is present, it can reduce the variance of the MDCT lines. In FIG. 17*c-iii*) a mechanism that adapts the estimated variances to the LTP is depicted. The figure shows a modification function $q_{LTP}$ over frequency f. The modified variances may be determined by $V_{LTPmod}==V \cdot q_{LTP}$. The value $L_{LTP}$ may be a function of the LTP gain so that $L_{LTP}$ is closer to 0 if the LTP gain is around 1 (indicating that the LTP has found a good match), and $L_{LTP}$ is closer to 1 if the LTP gain is around 0. The proposed LTP adaption of the variances $V=\{v_1, v_2, \ldots, v_j, \ldots v_N\}$ only affects MDCT lines below a certain frequency ($f_{LTPcutoff}$). In result, MDCT line variances below the cutoff frequency $f_{LTPcutoff}$ are reduced, the reduction being depending on the LTP gain.

FIG. 17*c-iv*) illustrates schematically the offset table construction. The nominal offset table is a matrix filled with pseudo random numbers distributed between −0.5 and 0.5. The number of columns in the matrix equals the number of MDCT lines that are coded by the MBMLQ. The number of rows is adjustable and equals the number of offsets vectors that are tested in the RD-optimization in the model-based entropy constrained encoder 1740 (see FIG. 17*e*). The offset table construction function scales the nominal offset table with the quantizer step size so that the offsets are distributed between $-\Delta/2$ and $+\Delta/2$.

Figure 17F:
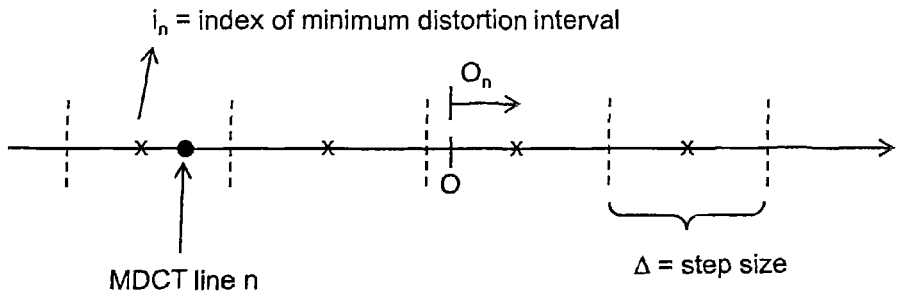
FIG. 17*f* illustrates schematically the operation of a uniform scalar quantizer (USQ) according to an embodiment of the invention.
Figure 17E:
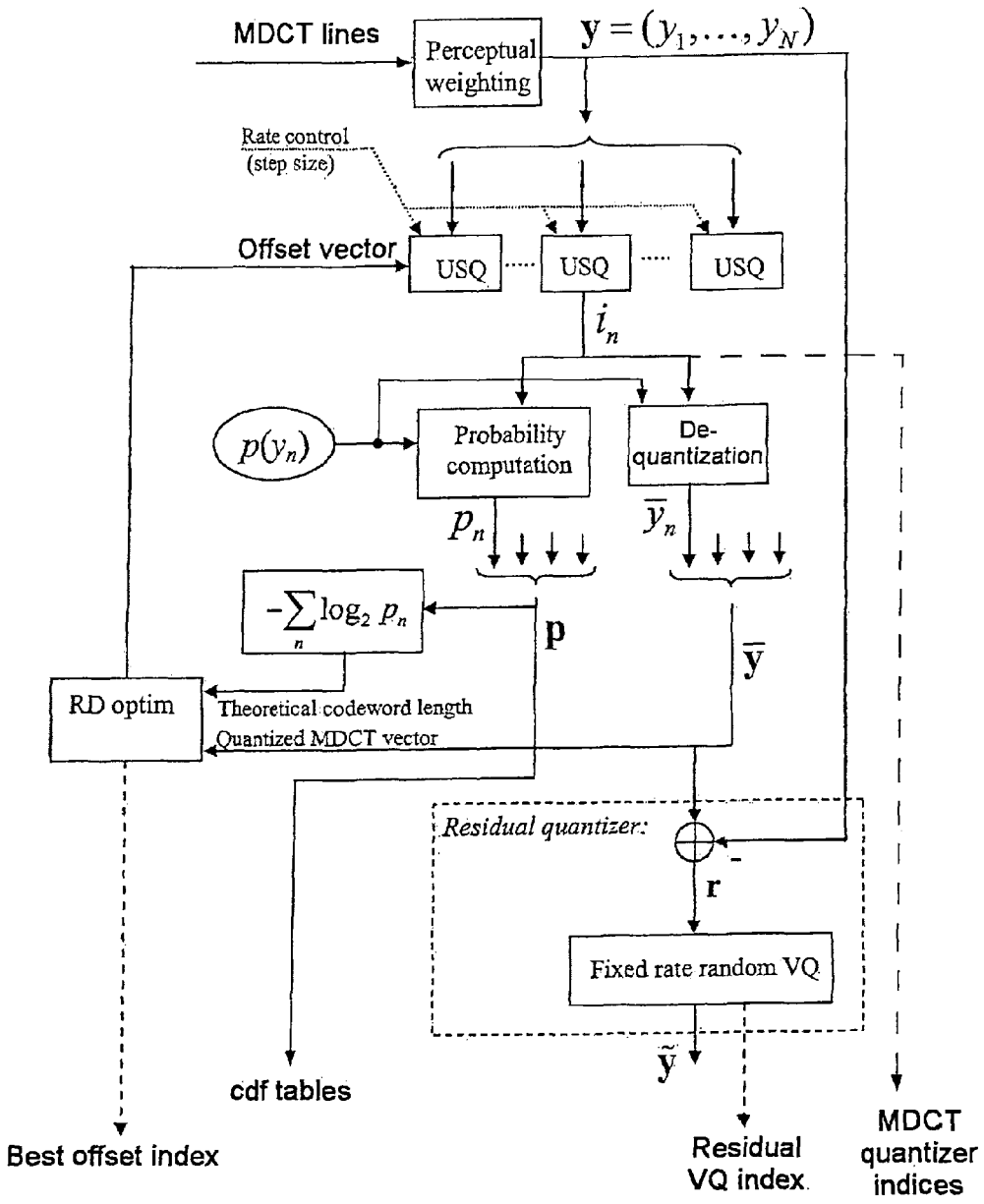
FIG. 17*e* illustrates schematically a model-based entropy constrained encoder according to an embodiment of the invention.
Figure 17G:
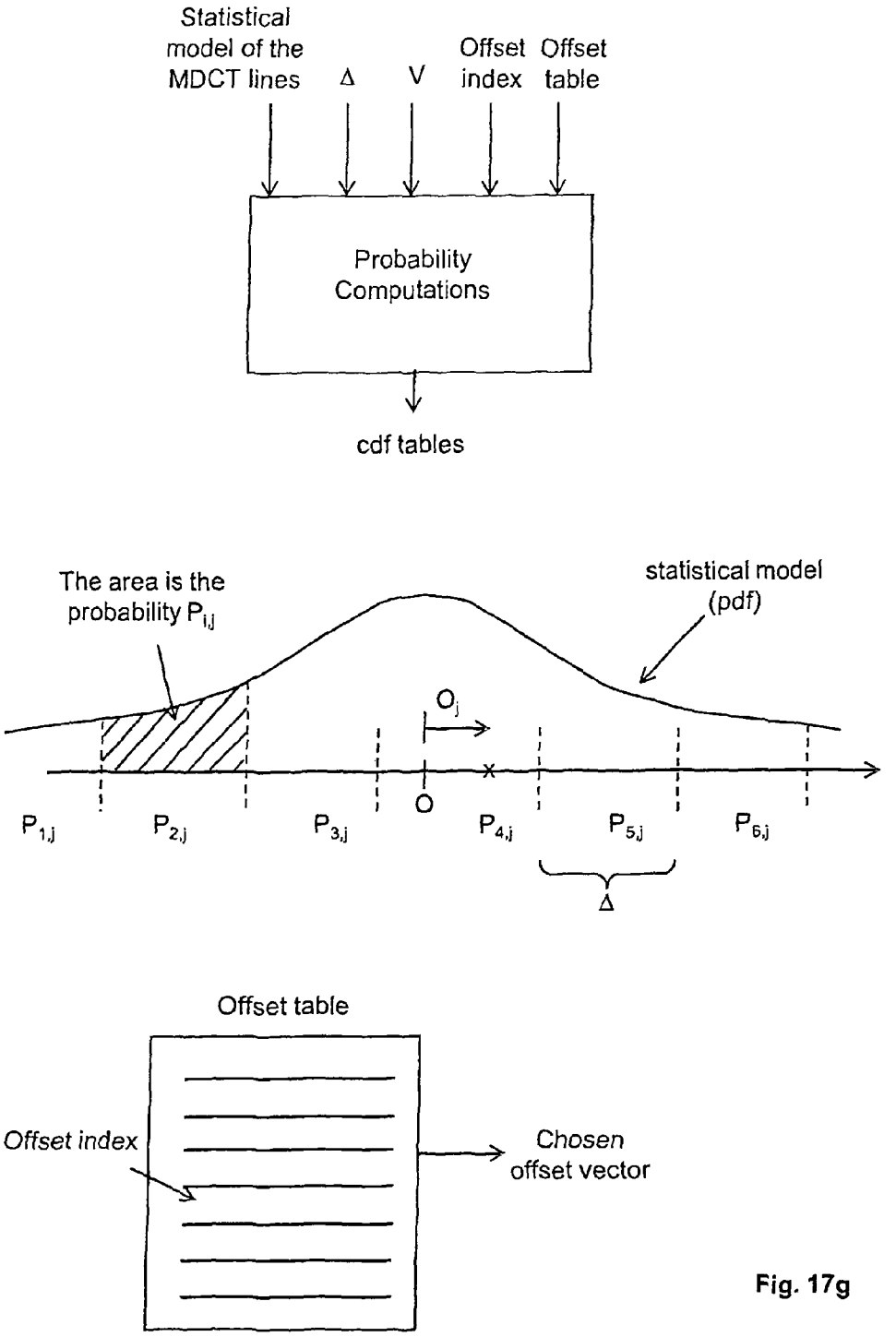
FIG. 17*g* illustrates schematically probability computations according to an embodiment of the invention.

FIG. 17*g* illustrates schematically an embodiment for an offset table. The offset index is a pointer into the table and selects a chosen offset vector $O=\{o_1, o_2, \ldots, o_n, \ldots, O_N\}$, where N is the number of MDCT lines in the MDCT frame.

As described below, the offsets provide a means for noise-filling. Better objective and perceptual quality is obtained if the spread of the offsets is limited for MDCT lines that have low variance $v_j$ compared to the quantizer step size Δ. An example of such a limitation is described in FIG. 17*c-iv*) where $k_1$ and $k_2$ are tuning parameters. The distribution of the offsets can be uniform and distributed between −s and +s. The boundaries s may be determined according to $$s = \begin{cases} k_2\sqrt{v_j} & \text{if } \sqrt{v_j} < k_1\Delta \\ \frac{\Delta}{2} & \text{otherwise} \end{cases}$$

For low variance MDCT lines (where $v_j$ is small compared to Δ) it can be advantageous to make the offset distribution non-uniform and signal dependent.

FIG. 17*e* illustrates schematically the model-based entropy constrained encoder 1740 in more detail. The input MDCT lines are perceptually weighed by dividing them with the values of the perceptual masking curve, preferably derived from the LPC polynomial, resulting in the weighted MDCT lines vector $y=(y_1, \ldots, y_N)$. The aim of the subsequent coding is to introduce white quantization noise to the MDCT lines in the perceptual domain. In the decoder, the inverse of the perceptual weighting is applied which results in quantization noise that follows the perceptual masking curve.

First, the iteration over the random offsets is outlined. The following operations are performed for each row j in the offset matrix: Each MDCT line is quantized by an offset uniform scalar quantizer (USQ), wherein each quantizer is offset by its own unique offset value taken from the offset row vector.

The probability of the minimum distortion interval from each USQ is computed in the probability computations module 1770 (see FIG. 17*g*). The USQ indices are entropy coded. The cost in terms of the number of bits required to encode the indices is computed as shown in FIG. 17*e* yielding a theoretical codeword length $R_j$. The overload border of the USQ of MDCT line j can be computed as $k_3 \cdot \sqrt{v_j}$, where $k_3$ may be chosen to be any appropriate number, e.g. 20. The overload border is the boundary for which the quantization error is larger than half the quantization step size in magnitude.

A scalar reconstruction value for each MDCT line is computed by the de-quantization module 1780 (see FIG. 17*h*) yielding the quantized MDCT vector $\bar{y}$. In the RD optimization module 1790 a distortion $D_j=d(y, \bar{y})$ is computed. $d(y, \bar{y})$ may be the mean squared error (MSE), or another perceptually more relevant distortion measure, e.g., based on a perceptual weighting function. In particular, a distortion measure that weighs together MSE and the mismatch in energy between y and $\bar{y}$ may be useful.

In the RD-optimization module 1790, a cost C is computed, preferably based on the distortion $D_j$ and/or the theoretical codeword length $R_j$ for each row j in the offset matrix. An example of a cost function is $C=10*\log_{10}(D_j)+\lambda*R_j/N$. The offset that minimizes C is chosen and the corresponding USQ indices and probabilities are output from the model-based entropy constrained encoder 1780.

The RD-optimization can optionally be improved further by varying other properties of the quantizer together with the offset. For example, instead of using the same, fixed variance estimate V for each offset vector that is tested in the RD-optimization, the variance estimate vector V can be varied. For offset row vector m, one would then use a variance estimate $k_m \cdot V$ where $k_m$ may span for example the range 0.5 to 1.5 as m varies from m=1 to m=(number of rows in offset matrix). This makes the entropy coding and MMSE computation less sensitive to variations in input signal statistics that the statistical model cannot capture. This results in a lower cost C in general.

The de-quantized MDCT lines may be further refined by using a residual quantizer as depicted in FIG. 17*e*. The residual quantizer may be, e.g., a fixed rate random vector quantizer.

The operation of the Uniform Scalar Quantizer (USQ) for quantization of MDCT line n is schematically illustrated in FIG. 17*f* which shows the value of MDCT line n being in the minimum distortion interval having index $i_n$. The 'x' markings indicate the center (midpoint) of the quantization intervals with step size Δ. The origin of the scalar quantizer is shifted by the offset $o_n$ from offset vector $O=\{o_1, o_2, \ldots, o_n, \ldots, o_N\}$. Thus, the interval boundaries and midpoints are shifted by the offset.

The use of offsets introduces encoder controlled noise-filling in the quantized signal, and by doing so, avoids spectral holes in the quantized spectrum. Furthermore, offsets increase the coding efficiency by providing a set of coding alternatives that fill the space more efficiently than a cubic lattice. Also, offsets provide variation in the probability tables that are computed by the probability computations module 1770, which leads to more efficient entropy coding of the MDCT lines indices (i.e. fewer bits required).

The use of a variable step size Δ (delta) allows for variable accuracy in the quantization so that more accuracy can be used for perceptually important sounds, and less accuracy can be used for less important sounds.

FIG. 17*g* illustrates schematically the probability computations in probability computation module 1770. The inputs to this module are the statistical model applied for the MDCT lines, the quantizer step size Δ, the variance vector V, the offset index, and the offset table. The output of the probability computation module 1770 are cdf tables. For each MDCT line $x_j$ the statistical model (i.e. a probability density function, pdf) is evaluated, The area under the pdf function for an interval i is the probability $p_{i,j}$ of the interval. This probability is used for the arithmetic coding of the MDCT lines.

Figure 17H:
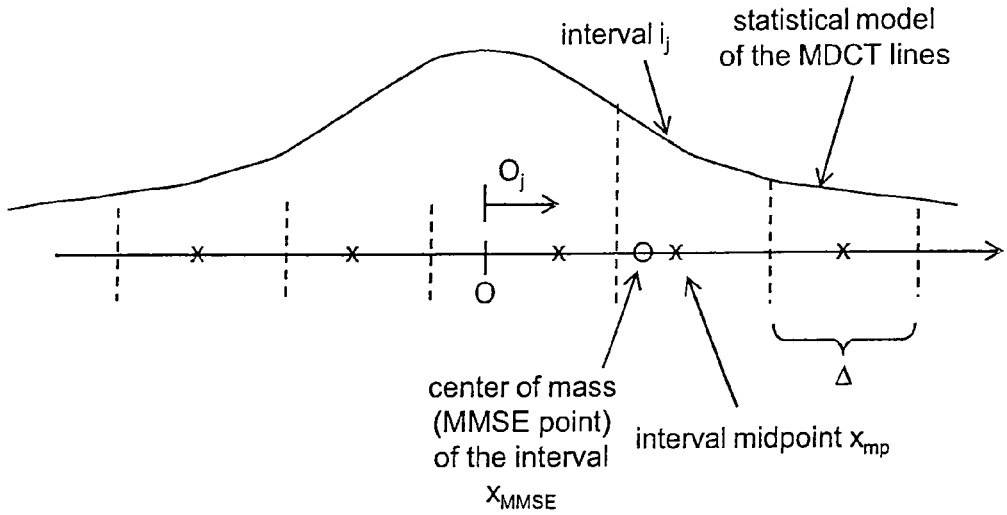
FIG. 17*h* illustrates schematically a de-quantization process according to an embodiment of the invention.

FIG. 17*h* illustrates schematically the de-quantization process as performed, e.g. in de-quantization module 1780. The center of mass (MMSE value) $x_{MMSE}$ for the minimum distortion interval of each MDCT line is computed together with the midpoint $x_{MP}$ of the interval. Considering that an N-dimensional vector of MDCT lines is quantized, the scalar MMSE value is suboptimal and in general too low. This results in a loss of variance and spectral imbalance in the decoded output. This problem may be mitigated by variance preserve decoding as described in FIG. 17*h* where the reconstruction value is computed as a weighted sum of the MMSE value and the midpoint value. A further optional improvement is to adapt the weight so that the MMSE value dominates for speech and the midpoint dominates for non-speech sounds. This yields cleaner speech while spectral balance and energy is preserved for non-speech sounds.

Variance preserving decoding according to an embodiment of the invention is achieved by determining the reconstruction point according to the following equation:

$$x_{dequant}=(1-\chi)x_{MMSE}+x_{MP}$$

Adaptive variance preserving decoding may be based on the following rule for determining the interpolation factor:

$$\chi = \begin{cases} 0 & \text{if speech sounds} \\ 1 & \text{if non-speech sounds} \end{cases}$$

The adaptive weight may further be a function of, for example, the LTP prediction gain $g_{LTP}$: $\chi=f(g_{LTP})$. The adaptive weight varies slowly and can be efficiently encoded by a recursive entropy code.

The statistical model of the MDCT lines that is used in the probability computations (FIG. 17*g*) and in the de-quantization (FIG. 17*h*) should reflect the statistics of the real signal. In one version the statistical model assumes the MDCT lines are independent and Laplacian distributed. Another version models the MDCT lines as independent Gaussians. One version models the MDCT lines as Guassian mixture models, including inter-dependencies between MDCT lines within and between MDCT frames. Another version adapts the statistical model to online signal statistics. The adaptive statistical models can be forward and/or backward adapted.

Figure 19:
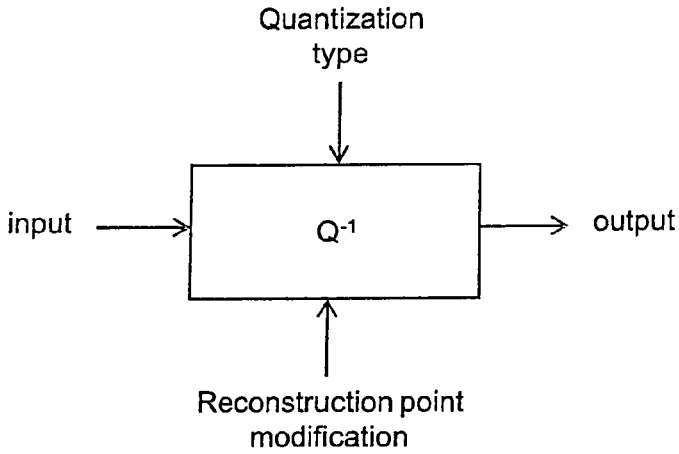
FIG. 19 illustrates a preferred embodiment of the inverse quantizer using different reconstruction points, according to the present invention.

Another aspect of the invention relating to the modified reconstruction points of the quantizer is schematically illustrated in FIG. 19 where an inverse quantizer as used in the decoder of an embodiment is depicted. The module has, apart from the normal inputs of an inverse-quantizer, i.e. the quantized lines and information on quantization step size (quantization type), also information on the reconstruction point of the quantizer. The inverse quantizer of this embodiment can use multiple types of reconstruction points when determining a reconstructed value $\bar{y}_n$ from the corresponding quantization index $i_n$. As mentioned above reconstruction values $\bar{y}$ are further used, e.g., in the MDCT lines encoder (see FIG. 17) to determine the quantization residual for input to the residual quantizer. Furthermore, quantization reconstruction is performed in the inverse quantizer 304 for reconstructing a coded MDCT frame for use in the LTP buffer (see FIG. 3) and, naturally, in the decoder.

The inverse-quantizer may, e.g., choose the midpoint of a quantization interval as the reconstruction point, or the MMSE reconstruction point. In an embodiment of the present invention, the reconstruction point of the quantizer is chosen to be the mean value between the centre and MMSE reconstruction points. In general, the reconstruction point may be interpolated between the midpoint and the MMSE reconstruction point, e.g., depending on signal properties such as signal periodicity. Signal periodicity information may be derived from the LTP module, for instance. This feature allows the system to control distortion and energy preservation. The center reconstruction point will ensure energy preservation, while the MMSE reconstruction point will ensure minimum distortion. Given the signal, the system can then adapt the reconstruction point to where the best compromise is provided.

The present invention further incorporates a new window sequence coding format. According to an embodiment of the invention, the windows used for the MDCT transformation are of dyadic sizes, and may only vary a factor two in size from window to window. Dyadic transform sizes are, e.g., 64, 128, . . . , 2048 samples corresponding to 4, 8, . . . , 128 ms at 16 kHz sampling rate. In general, variable size windows are proposed which can take on a plurality of window sizes between a minimum window size and a maximum size. In a sequence, consecutive window sizes may vary only by a factor of two so that smooth sequences of window sizes without abrupt changes develop. The window sequences as defined by an embodiment, i.e. limited to dyadic sizes and only allowed to vary a factor two in size from window to window, have several advantages. Firstly, no specific start or stop windows are needed, i.e. windows with sharp edges. This maintains a good time/frequency resolution. Secondly, the window sequence becomes very efficient to code, i.e. to signal to a decoder what particular window sequence is used. Finally, the window sequence will always fit nicely into a hyperframe structure.

The hyper-frame structure is useful when operating the coder in a real-world system, where certain decoder configuration parameters need to be transmitted in order to be able to start the decoder. This data is commonly stored in a header field in the bitstream describing the coded audio signal. In order to minimize bitrate, the header is not transmitted for every frame of coded data, particularly in a system as proposed by the present invention, where the MDCT frame-sizes may vary from very short to very large. It is therefore proposed by the present invention to group a certain amount of MDCT frames together into a hyper frame, where the header data is transmitted at the beginning of the hyper frame. The hyper frame is typically defined as a specific length in time. Therefore, care needs to be taken so that the variations of MDCT frame-sizes fits into a constant length, pre-defined hyper frame length. The above outlined inventive window-sequence ensures that the selected window sequence always fits into a hyper-frame structure.

According to an embodiment of the present invention, the LTP lag and the LTP gain are coded in a variable rate fashion. This is advantageous since, due to the LTP effectiveness for stationary periodic signals, the LTP lag tends to be the same over somewhat long segments. Hence, this can be exploited by means of arithmetic coding, resulting in a variable rate LTP lag and LTP gain coding.

Similarly, an embodiment of the present invention takes advantage of a bit reservoir and variable rate coding also for the coding of the LP parameters. In addition, recursive LP coding is taught by the present invention.

Figure 18:
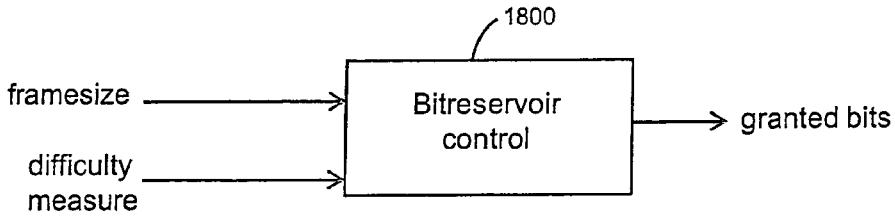
FIG. 18 illustrates a preferred embodiment of a bit reservoir control, according to the present invention.

Another aspect of the present invention is the handling of a bit reservoir for variable frame sizes in the encoder. In FIG. 18 a bit reservoir control unit 1800 according to the present invention is outlined. In addition to a difficulty measure provided as input, the bit reservoir control unit also receives information on the frame length of the current frame. An example of a difficulty measure for usage in the bit reservoir control unit is perceptual entropy, or the logarithm of the power spectrum. Bit reservoir control is important in a system where the frame lengths can vary over a set of different frame lengths. The suggested bit reservoir control unit 1800 takes the frame length into account when calculating the number of granted bits for the frame to be coded as will be outlined below.

The bit reservoir is defined here as a certain fixed amount of bits in a buffer that has to be larger than the average number of bits a frame is allowed to use for a given bit rate. If it is of the same size, no variation in the number of bits for a frame would be possible. The bit reservoir control always looks at the level of the bit reservoir before taking out bits that will be granted to the encoding algorithm as allowed number of bits for the actual frame. Thus a full bit reservoir means that the number of bits available in the bit reservoir equals the bit reservoir size. After encoding of the frame, the number of used bits will be subtracted from the buffer and the bit reservoir gets updated by adding the number of bits that represent the constant bit rate. Therefore the bit reservoir is empty, if the number of the bits in the bit reservoir before coding a frame is equal to the number of average bits per frame.

Figure 18A:
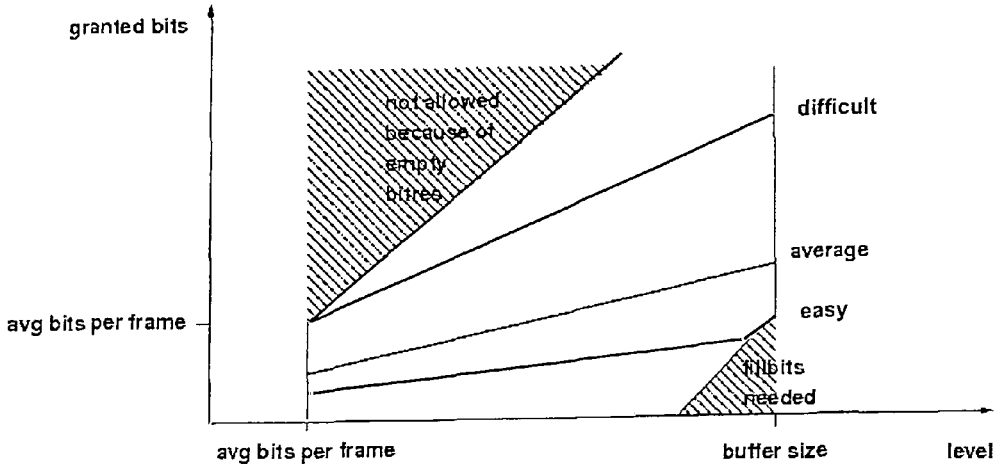
FIG. 18*a* illustrates the basic concept of a bit reservoir control.

In FIG. 18*a* the basic concept of bit reservoir control is depicted. The encoder provides means to calculate how difficult to encode the actual frame compared to the previous frame is. For an average difficulty of 1.0, the number of granted bits depends on the number of bits available in the bit reservoir. According to a given line of control, more bits than corresponding to an average bit rate will be taken out of the bit reservoir if the bit reservoir is quite full. In case of an empty bit reservoir, less bits compared to the average bits will be used for encoding the frame. This behavior yields to an average bit reservoir level for a longer sequence of frames with average difficulty. For frames with a higher difficulty, the line of control may be shifted upwards, having the effect that difficult to encode frames are allowed to use more bits at the same bit reservoir level. Accordingly, for easy to encode frames, the number of bits allowed for a frame will be lower just by shifting down the line of control in FIG. 18*a* from the average difficulty case to the easy difficulty case. Other modifications than simple shifting of the control line are possible, too. For instance, as shown in FIG. 18*a* the slope of the control curve may be changed depending on the frame difficulty.

When calculating the number of granted bits, the limits on the lower end of the bit reservoir have to be obeyed in order not to take out more bits from the buffer than allowed. A bit reservoir control scheme including the calculation of the granted bits by a control line as shown in FIG. 18*a* is only one example of possible bit reservoir level and difficulty measure to granted bits relations. Also other control algorithms will have in common the hard limits at the lower end of the bit reservoir level that prevent a bit reservoir to violate the empty bit reservoir restriction, as well as the limits at the upper end, where the encoder will be forced to write fill bits, if a too low number of bits will be consumed by the encoder.

Figure 18B:
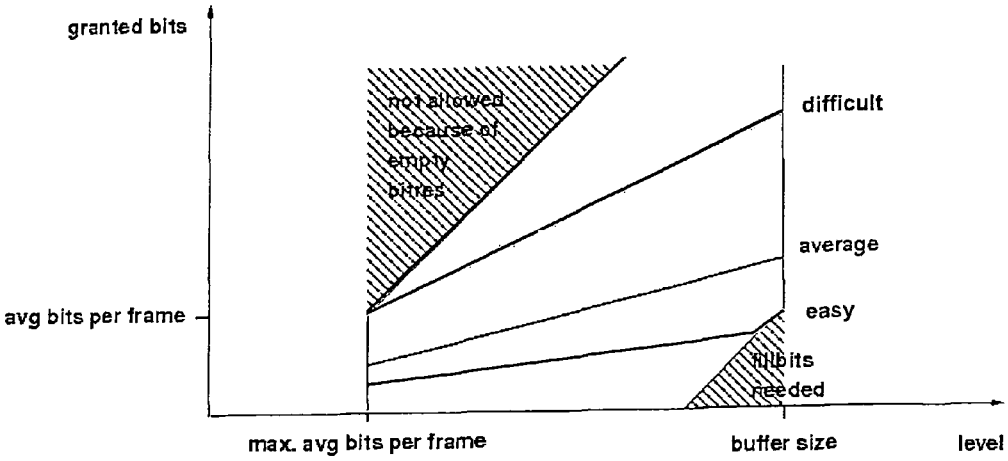
FIG. 18*b* illustrates the concept of a bit reservoir control for variable frame sizes, according to the present invention.

For such a control mechanism being able to handle a set of variable frame sizes, this simple control algorithm has to be adapted. The difficulty measure to be used has to be normalized so that the difficulty values of different frame sizes are comparable. For every frame size, there will be a different allowed range for the granted bits, and because the average number of bits per frame is different for a variable frame size, consequently each frame size has its own control equation with its own limitations. One example is shown in FIG. 18*b*. An important modification to the fixed frame size case is the lower allowed border of the control algorithm. Instead of the average number of bits for the actual frame size, which corresponds to the fixed bit rate case, now the average number of bits for the largest allowed frame size is the lowest allowed value for the bit reservoir level before taking out the bits for the actual frame. This is one of the main differences to the bit reservoir control for fixed frame sizes. This restriction guarantees that a following frame with the largest possible frame size can utilize at least the average number of bits for this frame size.

The difficulty measure may be based, e.g., a perceptual entropy (PE) calculation that is derived from masking thresholds of a psychoacoustic model as it is done in AAC, or as an alternative the bit count of a quantization with fixed step size as it is done in the ECQ part of an encoder according to an embodiment of the present invention. These values may be normalized with respect to the variable frame sizes, which may be accomplished by a simple division by the frame length, and the result will be a PE respectively a bit count per sample. Another normalization step may take place with regard to the average difficulty. For that purpose, a moving average over the past frames can be used, resulting in a difficulty value greater than 1.0 for difficult frames or less than 1.0 for easy frames. In case of a two pass encoder or of a large lookahead, also difficulty values of future frames could be taken into account for this normalization of the difficulty measure.

Another aspect of the invention relates to specifics of the bit reservoir handling for ECQ. The bit reservoir management for ECQ works under the assumption that ECQ produces an approximately constant quality when using a constant quantizer step size for encoding. Constant quantizer step size produces a variable rate and the objective of the bit reservoir is to keep the variation in quantizer step size among different frames as small as possible, while not violating the bit reservoir buffer constraints. In addition to the rate produced by the ECQ, additional information (e.g. LTP gain and lag) is transmitted on an MDCT-frame basis. The additional information is in general also entropy coded and thus consumes different rate from frame to frame.

In an embodiment of the invention, a proposed bit reservoir control tries to minimize the variation of ECQ step size by introducing three variables (see FIG. 18*c*):

$R_{ECQ_AVG}$: Average ECQ rate per sample used previously;

$\Delta_{ECQ_AVG}$: Average quantizer step size used previously.

These variables are both updated dynamically to reflect the latest coding statistics.

$R_{ECQ_AVG_DES}$: The ECQ rate corresponding to average total bitrate.

This value will differ from $R_{ECQ_AVG}$ in case the bit reservoir level has changed during the time frame of the averaging window, e.g. a bitrate higher or lower than the specified average bitrate has been used during this time frame. It is also updated as the rate of the side information changes, so that the total rate equals the specified bitrate.

Figure 18C:
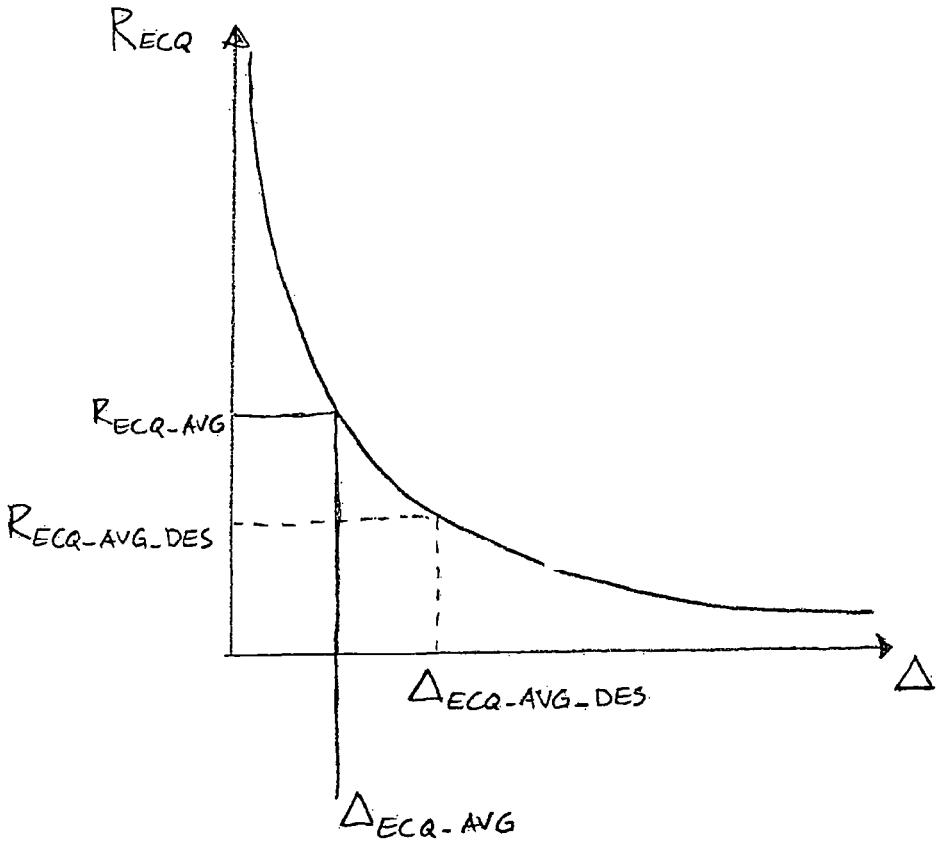
FIG. 18*c* shows an exemplary control curve for bit reservoir control according to an embodiment.

The bit reservoir control uses these three values to determine an initial guess on the delta to be used for the current frame. It does so by finding $\Delta_{ECG_AVG_DES}$ on the $R_{ECQ}$–× curve shown in FIG. 18*c* that corresponds to $R_{ECQ_AVG_DES}$. In a second stage this value is possibly modified if the rate is not in accordance with the bit reservoir constraints. The exemplary $R_{ECQ}$–Δ curve in FIG. 18*c* is based on the following equation:

$$R_{ECQ} = \frac{1}{2}\log_2 \frac{\alpha}{\Delta^2}$$

Of course, other mathematical relationships between $R_{ECQ}$ and Δ may be used, too.

In the stationary case, $R_{ECQ_AVG}$ will be close to $R_{ECQ_AVG_DES}$ and the variation in Δ will be very small. In the non-stationary case, the averaging operation will ensure a smooth variation of Δ.

While the foregoing has been disclosed with reference to particular embodiments of the present invention, it is to be understood that the inventive concept is not limited to the described embodiments. On the other hand, the disclosure presented in this application will enable a skilled person to understand and carry out the invention. It will be understood by those skilled in the art that various modifications can be made without departing from the spirit and scope of the invention as set out exclusively by the accompanying claims.

The invention claimed is:

1. Audio coding system comprising:

a linear prediction unit for filtering an input signal based on an adaptive filter;

a transformation unit for transforming a frame of the filtered input signal into a transform domain;

a quantization unit for quantizing the transform domain signal;

a scalefactor determination unit for generating scalefactors, based on a masking threshold curve, for usage in the quantization unit when quantizing the transform domain signal;

a linear prediction scalefactor estimation unit for estimating linear prediction based scalefactors based on parameters of the adaptive filter; and a scalefactor encoder for encoding the difference between the masking threshold curve based scalefactors and the linear prediction based scalefactors.

2. Audio coding system of claim 1, wherein the linear prediction scalefactor estimation unit comprises a perceptual masking curve estimation unit to estimate a perceptual masking curve based on the parameters of the adaptive filter, wherein the linear prediction based scalefactors are determined based on the estimated perceptual masking curve.

3. Audio coding system of claim 1, wherein the linear prediction based scalefactors for a frame of the transform domain signal are estimated based on interpolated linear prediction parameters.

4. Audio coding system according to claim 1, comprising a bit reservoir control unit for determining the number of bits granted to encode a frame of the filtered signal based on the length of the frame and a difficulty measure of the frame.

5. Audio coding system of claim 4, wherein the bit reservoir control unit has separate control equations for different frame difficulty measures and/or different frame sizes.

6. Audio coding system of claim 4, wherein the bit reservoir control unit sets the lower allowed limit of the granted bit control algorithm to the average number of bits for the largest allowed frame size.

7. Audio decoder comprising:

a de-quantization unit for de-quantizing a frame of an input bitstream based on scalefactors;

an inverse transformation unit for inversely transforming a transform domain signal;

a linear prediction unit for filtering the inversely transformed transform domain signal; and a scalefactor decoding unit for generating the scalefactors used in de-quantization based on received scalefactor delta information that encodes the difference between the scalefactors applied in the encoder and scalefactors that are generated based on parameters of an adaptive filter.

8. Audio decoder of claim 7, comprising a scalefactor determination unit for generating scalefactors based on a masking threshold curve that is derived from linear prediction parameters for the present frame, wherein the scalefactor decoding unit combines the received scalefactor delta information and the generated linear prediction based scalefactors to generate scalefactors for input to the de-quantization unit.

9. A method for decoding an audio signal comprising the steps:

de-quantizing a frame of an input bitstream based on scalefactors;

inversely transforming a transform domain signal;

linear prediction filtering the inversely transformed transform domain signal;

estimating second scalefactors based on parameters of an adaptive filter;

generating the scalefactors used in de-quantization based on received scalefactor difference information and the estimated second scalefactors; and outputting the audio signal.

* * * * *

UNITED STATES PATENT AND TRADEMARK OFFICE

CERTIFICATE OF CORRECTION

PATENT NO. : 8,484,019 B2
APPLICATION NO. : 12/811421
DATED : July 9, 2013
INVENTOR(S) : Per Hedelin et al.

It is certified that error appears in the above-identified patent and that said Letters Patent is hereby corrected as shown below:

On the title page, item (73)-please delete the Assignee

"Dolby Laboratories Licensing Corporation, San Francisco, CA (USA)"

and replace with the correct Assignee name:

--Dolby International AB, Amsterdam Zuidoost, The Netherlands--

Signed and Sealed this
Sixth Day of August, 2013

Teresa Stanek Rea
*Acting Director of the United States Patent and Trademark Office*